US012320247B2

(12) United States Patent
Zhao et al.

(10) Patent No.: US 12,320,247 B2
(45) Date of Patent: Jun. 3, 2025

(54) APPARATUS AND METHOD FOR EVALUATING LIGHTWEIGHT CEMENT BONDS IN DOWNHOLE

(71) Applicant: GOWell International, LLC, Houston, TX (US)

(72) Inventors: Jinsong Zhao, Houston, TX (US); Hichem Abdelmoula, Houston, TX (US)

(73) Assignee: GOWell International, LLC, Houston, TX (US)

( * ) Notice: Subject to any disclaimer, the term of this patent is extended or adjusted under 35 U.S.C. 154(b) by 314 days.

(21) Appl. No.: 18/096,491

(22) Filed: Jan. 12, 2023

(65) Prior Publication Data

US 2023/0220764 A1 Jul. 13, 2023

Related U.S. Application Data

(60) Provisional application No. 63/299,024, filed on Jan. 13, 2022.

(51) Int. Cl.
*E21B 47/005* (2012.01)

(52) U.S. Cl.
CPC ..... *E21B 47/005* (2020.05); *E21B 2200/20* (2020.05); *E21B 2200/22* (2020.05)

(58) Field of Classification Search
CPC . E21B 47/005; E21B 2200/20; E21B 2200/22
See application file for complete search history.

(56) References Cited

U.S. PATENT DOCUMENTS 4,733,380 A * 3/1988 Havira ..... E21B 47/006 73/152.58
2011/0149684 A1* 6/2011 Hurst ..... G01V 1/46 367/34
2021/0238978 A1* 8/2021 Singh ..... E21B 47/07

FOREIGN PATENT DOCUMENTS

WO WO-2015153823 A1 * 10/2015 ..... E21B 33/14

* cited by examiner

*Primary Examiner* — Isam A Alsomiri
*Assistant Examiner* — Abdallah Abulaban
(74) *Attorney, Agent, or Firm* — Barry Choobin; Patent 360

(57) ABSTRACT

A method and apparatus for evaluating light-weight cement (LWC) bond conditions in production well in presence or absence of the tubing. The apparatus includes a tool string that can be lowered into the casing or the tubing. The tool string includes a segmented transducer ring matrix to excite the surrounding medium resulting in vibrations. The tool string further includes an impedance measurement circuit that can determine natural resonance frequencies of the structural components. The impedance measurement circuit can determine certain non-harmonic resonance mode shapes for mechanical impedance measurements that are sensitive to the LWC bond conditions. A machine learning model can be used for segmented impedance measurements to correct effects from the tubing eccentricity inside the casing. Lab calibration generates bond index mapping table and the field logging impedance measurement data can be processed into the bond indexes to further evaluate LWC bond conditions.

14 Claims, 19 Drawing Sheets

APPARATUS AND METHOD FOR EVALUATING LIGHTWEIGHT CEMENT BONDS IN DOWNHOLE

CROSS-REFERENCE TO RELATED APPLICATIONS

This application claims priority to the U.S. provisional patent application Ser. No. 63/299,024, filed on Jan. 13, 2022, which is incorporated herein by reference in its entirety.

FIELD OF INVENTION

The present invention relates to an apparatus and method for downhole applications, and more particularly, the present invention relates to an apparatus and method for detecting interface bond conditions in between casing and lightweight cement (LWC) and/or in between LWC and formation downhole in a production well.

BACKGROUND OF THE INVENTION

As the environmental regulations are becoming stricter, cementing operation in the production wells are becoming more common. The cementing supports the casings, isolates different formations, and prevent fluid movements within the well. Multiple cement types are used for zoning applications; however, the cementing itself poses several challenges. Regular cements have much higher density than downhole fluids which causes deep formation fracturing and invasion, resulting in clogged formation pores and loss of permeability. Low weight cement (LWC) having the density in the range of the one of the borehole fluids is preferred to prevent drawbacks with regular cements. LWC plays a key role in zoning application for production wells, however, the integrity of cement bond conditions deteriorates over the life span of the production well due to tectonic motion, confine pressure, and operational intervention. These necessities that the LWC bond conditions in a production well must be evaluated periodically.

The conventional methods for downhole inspection mainly rely on sonic and ultrasonic logging instruments using acoustic wave propagation measurement methods, configured in pitch-catch or pulse-echo formats. Such methods detect the acoustic progressive wave (P-wave) reflected at the interfaces of different layers in the casing-cement and in casing-formation. The level of wave reflection ratio, defined as reflection coefficient, depends on the material acoustic impedance differences across the interfaces. Since the acoustic impedance of LWC is in the similar range to the one of borehole fluids, the evaluation of LWC bond conditions is not reliable by using the P-wave reflection method. Other tools are also known that uses Lamb wave (L-wave) in lateral propagation or shear wave (S-wave) in azimuthal propagation, excited effectively through the contact pads, for LWC bond condition evaluations. A good LWC casing-cement bond condition couple considerable amount of shear energy carried by L-wave or S-wave propagations into the cement and, furthermore, into the formation resulting in relatively small portion of acoustic wave energy return to the acoustic receiver(s) to be measured as energy losses or acoustic wave attenuation. Therefore, the better the cement bond condition, the more acoustic energy losses across the casing-cement and cement-formation interferences, the higher the attenuation of the propagated wave could be measured. As the result, the LWC bond condition can be evaluated. However, such methods usually rely on direct-contact-casing pads to ensure the excitations of L-wave or S-wave. None of the methods can reliably evaluate the LWC bond conditions when a tubing is inserted in front of the casing and where the L-wave or S-wave cannot be excited effectively. Thus, removal of tubing before LWC inspection become essential for reliable results. However, the removal of tubing is an expensive and time-consuming procedure.

An industrial need is therefore appreciated for a novel method for inspecting cement bond conditions without the need for removing the tubing.

BRIEF SUMMARY OF THE INVENTION

The following presents a brief summary of one or more embodiments of the present invention to provide a primary understanding of such embodiments. This summary does not include an in-depth description of all contemplated embodiments and is intended to neither identify key or critical elements of all embodiments nor delineate the scope of any or all embodiments. Its only purpose is to present some concepts of one or more embodiments in a simplified form as an introduction to the more detailed description that is presented later.

The principal object of the present invention is therefore directed to an apparatus and method for evaluating lightweight cement bond conditions without the need for removing the tubing.

It is another object of the present invention that the LWC bonds can be measured in presence or absence of the tubing.

It is still another object of the present invention that the measurement accuracy is high.

It is a further object of the present invention that the apparatus can compensate for the tubing eccentricity inside and against the casing.

In one aspect, disclosed is an apparatus and method for inspecting cement bond conditions in a production well. The disclosed apparatus includes a tool string and a surface unit. The tool string can be connected to the surface unit through a wireline. The tool string includes a telemetry unit, a centralizer unit, and a cement bond logging (CBL) unit.

In one aspect, the CBL unit includes a transducer matrix, an impedance measurement circuit, an acquisition module, and a communication unit. The transducer matrix can include one or more cylindrical acoustic transducer arrays. Each cylindrical acoustic transducer array can be combined with one or more acoustic azimuthal transducer rings.

In one aspect, the centralizer unit is configured to centralize the tool string within the tubing. In case of eccentricity of the tubing relative to the casing, the tool string may remain centralized to the tubing. In the absence of the tubing, the tool string can be centralized to the casing.

In one aspect, disclosed is a method for evaluating the TT-LWC bond conditions behind the casing of a wellbore. The disclosed method can use the forced elastic structure nonharmonic resonance method (duffing resonance) to determine the LWC bond condition. The transducer matrix is continuously driven by a periodic sinusoidal or square voltage signal in pre-selected frequency or frequencies with normal incidence to actuate the elastic structure intrinsic resonances. The resonance peaks on frequency spectrum in selected resonance modal shapes are measured in current or impedance from the transducer and analysed for evaluating the LWC bond condition and quality.

In one aspect, this apparatus does not require the removal of the tubing prior to inspection. Also, it can be used for evaluating newly cemented wells before the production when tubing is inserted.

BRIEF DESCRIPTION OF THE DRAWINGS

For better explanation of for the embodiments of the present invention. The accompanying drawing are listed. Together with the description, the figures further explain the principles of the present invention and enable a person skilled in the relevant arts to make and use the invention.

DETAILED DESCRIPTION OF THE INVENTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

Disclosed are an apparatus and method for nondestructively evaluating lightweight cement (LWC) bonds behind the casing. The disclosed method includes measuring the nonharmonic resonance modes of the coupled elastic structure made of the multiple strings in a production well. The disclosed apparatus may include a tool string and a periodic voltage source. The tool string includes piezoelectric transmitter, impedance measurement circuit, acquisition module, processing module, and communication module. The piezoelectric transmitter can generate harmonic vibrations by the means of being powered by the periodic voltage source. The generated acoustic vibrations can propagate through the well and are attenuated while traveling the formation. The production well including the water/tubing/water/casing/lightweight cement is assumed herein as a mechanical system. The mechanical system has multiple resonance frequencies, wherein the one or more of resonance frequencies of the mechanical system upon matching the driving frequency generated by the disclosed apparatus results in the mechanical energy coupled from the apparatus to the mechanical system to reach its maximum. The resonance frequency of the mechanical system is highly affected by different components of the wellbore including the lightweight cement layer condition behind the casing. Any damage or modification in the lightweight cement layer will shift the natural resonance frequency of the mechanical system and its total energy. The disclosed apparatus determines/estimates the resonance frequency as well as the total dissipated energy through evaluating the current required to drive the piezoelectric transmitter. The following description of the illustrations will further provide a thorough understanding of the invention.

Figure 1B:
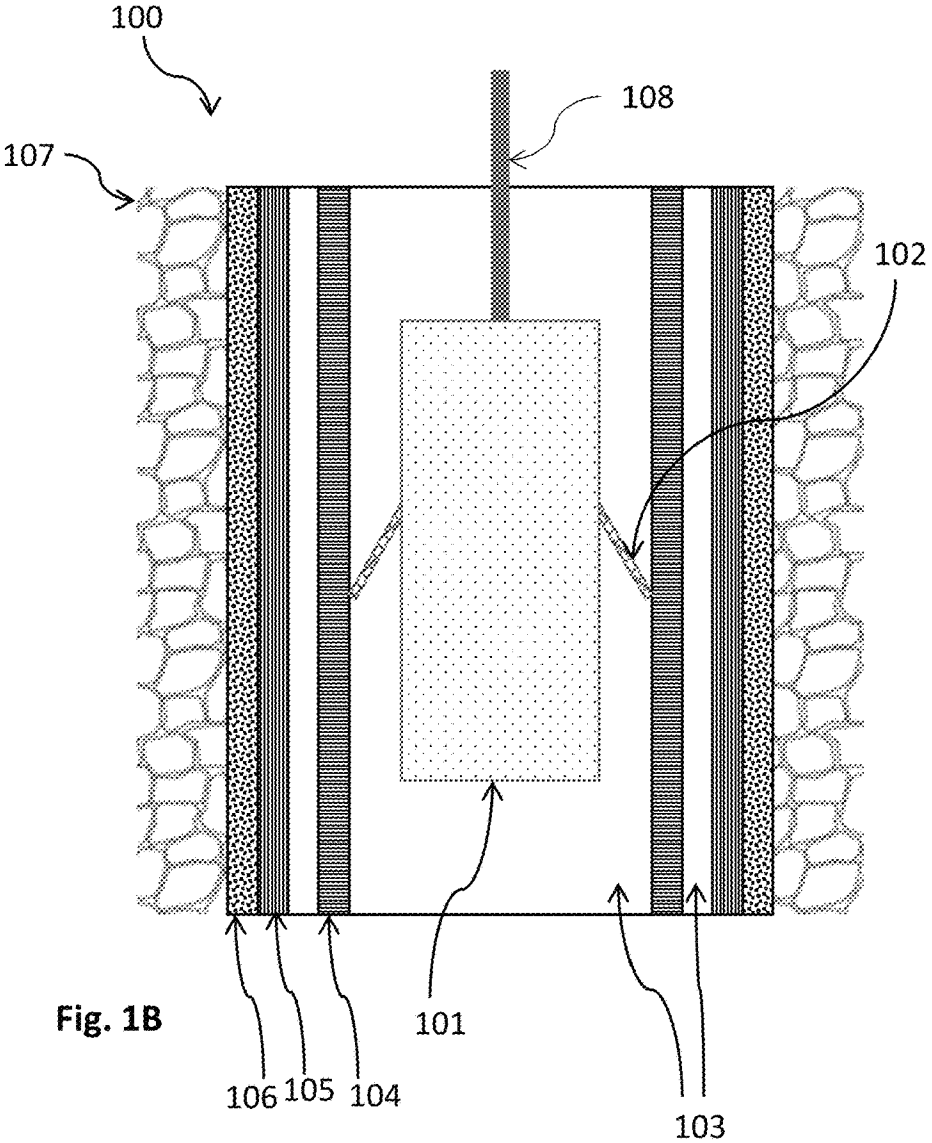
FIG. 1*a* is a top view and FIG. 1*b* is a lateral view showing a production well and a tool string, according to an exemplary embodiment of the present invention.
Figure 1A:
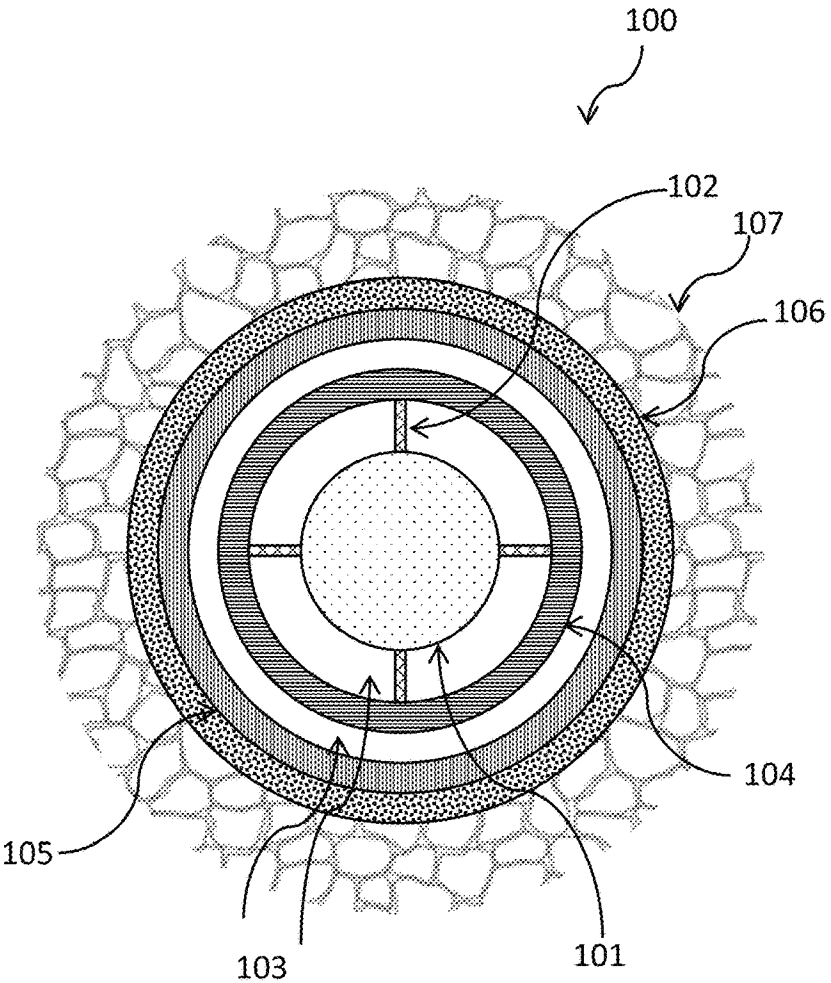

Referring to FIGS. 1*a* and 1*b* which show a typical production well 100, wherein FIG. 1*a* is a top schematic view and FIG. 1*b* shows a side schematic view of the production well. The production well includes a tubing 104, a casing 105, cement layer 106, and a formation 107. The inner volume of the tubing and an annular space between the tubing and the casing can be filled with borehole fluids 103, such as water. A tool string 101 of the disclosed apparatus can be lowered into the tubing and the evaluations according to the present invention can be done in presence of the tubing. The apparatus may also include a centralizer 102 that can be used to centralize the tool string relative to the tubing or casing. The centralizer can include two or more pivotable arms that can push against a surrounding structure to balance the tool string. A wireline cable 108 can be used to suspend the tool string in the production well.

The tool string is usually inserted inside the tubing with one or more centralizers to keep the tool string in the center of the tubing. However, the tubing itself may or may not be centralized relative to the casing. Moreover, cement layer can be regular cement or LWC, which fills the area between the casing and the formation to form an isolation zone(s) wherein the downhole fluids cannot flow or leak through. Hereinafter the term "cement" refers to LWC, and the terms "cement" and "LWC" are interchangeably used herein after. Also, in different instances, this area can be filled with borehole fluids, for example brine water. In other applications, the tubing may be removed, and the tool string can be centralized by one or more centralizers against the inner surface of the casing. The wireline cable can connect the tool string to the surface logging unit (not shown) for data communication and driving the tool string and one or more centralizers up and down to conduct the measuring activities. It is to be noted that the purpose/objectives of the logging operations are for LWC bond condition inspection and evaluation.

In the conventional acoustic wave propagation methods that works without the presence of a tubing, a conventional logging tool emits an acoustic wave into the borehole fluids around the conventional logging tool inside the casing or directly couples the wave, in some cases with and through its pad(s), into the casing 105. The acoustic waves get transmitted into the production well across multiple layers and interfaces, wherein the principle of acoustic wave propagation reflection and refraction on an interface governs the portions of acoustic wave energy to be reflected from and to be refracted into the interfaces. Eventually, after multiple refractions through each of the interfaces, the remaining portion of the acoustic wave gets into the formation and gets absorbed gradually as the acoustic wave propagates further away. A portion of the reflected acoustic wave through the multiple interfaces of the layers back inside the casing can be received and measured by the conventional logging tool. A certain portion of the measured signal from the total received acoustic wave corresponds to the acoustic wave reflected from the interface of the casing and the cement, which contains the information of the casing and cement interface bond conditions. The rest of received signals are called ambient acoustic interferences from the acoustic reflections other than from the casing-cement interface. Nevertheless, the received signal can be used for cement bond condition evaluations. The higher the percentage of the desired certain portion of the measured signal, the lesser is the ambient acoustic interferences, and higher is the sensitivity and signal-to-noise ratio (SNR) in signal measurements. Higher sensitivity and signal-to-noise ratio (SNR) makes the process of evaluating casing-cement interface bond conditions from the measurement signals more reliable and precise. The process becomes more challenging in the presence of tubing. The acoustic wave gets reflected and diffracted through the additional interfaces of the tubing and the casing. These additional reflections and diffractions introduced as a result of tubing are undesired and generate both extra acoustic wave attenuations and extra ambient acoustic interferences that largely reduce the signal sensitivity and SNR.

Figure 2:
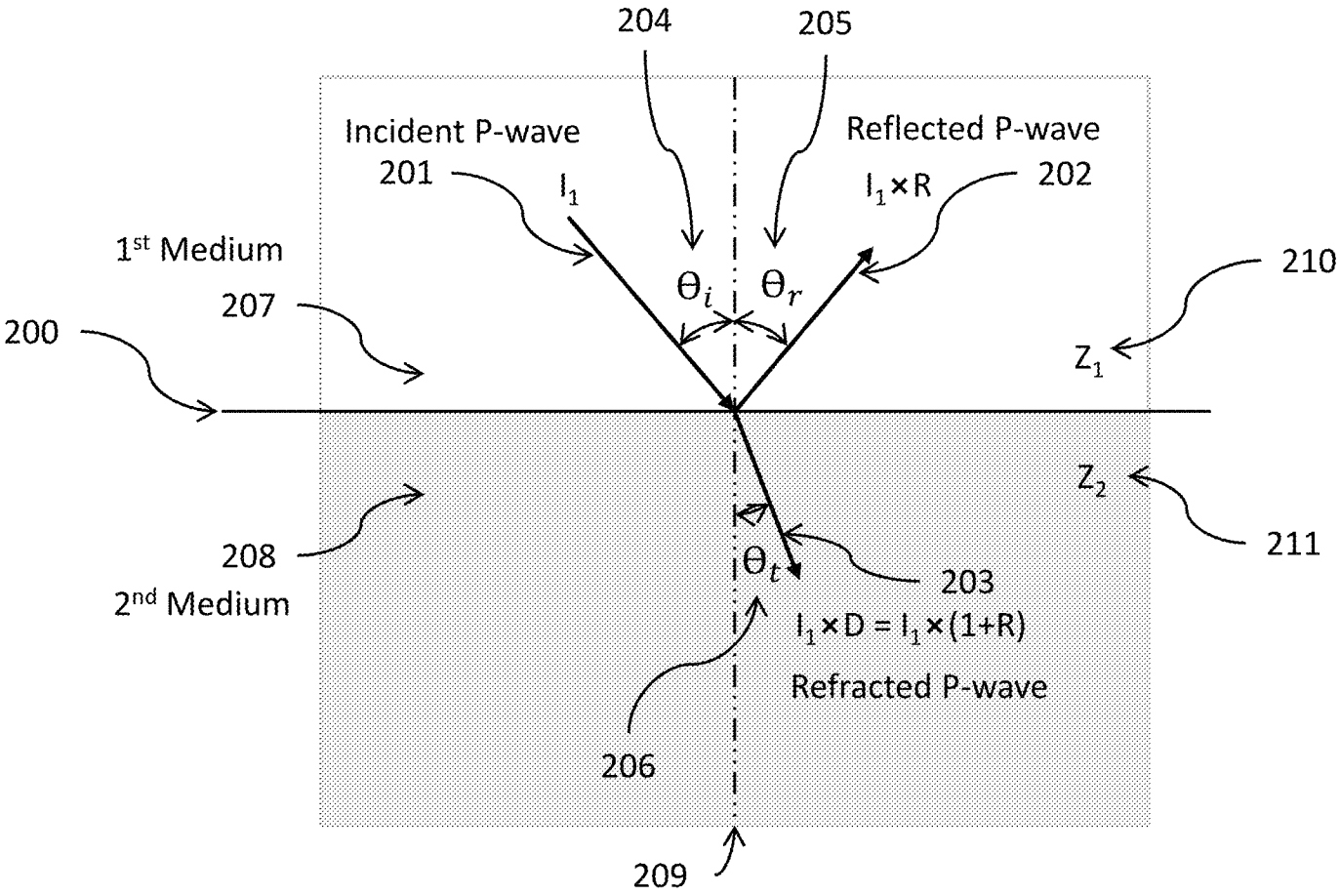
FIG. 2 is a diagram illustrating acoustic wave propagation reflection and impedance differences across the interfaces for cement evaluation according to prior art.

FIG. 2 illustrates the wave propagation reflection method used for cement bond evaluations in accordance with prior art. The method relies on a system that generates acoustic wave 201 that propagates into the $1^{st}$ medium 207 with an acoustic impedance $Z_1$ 210. Once the wave 201 with an amplitude $I_1$ reaches the interface 200 in between the medium 207 and the medium 208, certain portion of the wave propagates into medium 208 as the refracted wave 203 in the angle $\theta_t$ 206 between the wave propagation direction 203 and the normal direction 209 to the interface 200. The refracted angle $\theta_t$ 206 depends on the acoustic impedances, 210 and 211, of both mediums, 207 and 208, and the incident angle $\theta_i$. The amplitude of the refracted wave 203 is proportional to the refraction coefficient D and the amplitude of incident wave 201. The rest of portion of the wave 202 is reflected in an angle $\theta_r$ 205 which is equal to the incidence angle $\theta_i$ 204, shown in the Equation (1-0). The amplitude of the reflected wave 202 is proportional to the reflection coefficient R and the amplitude of incident wave 201. The reflection coefficient R can be estimated based on the impedance values 210 and 211 of both mediums, 207 and 208, as shown below in Equation (1-1). In a real well cement evaluation, the reflection coefficient R is estimated based on the amplitude measurements of the incident wave and reflected wave based on the Equation (1-1). The acoustic impedance of the $2^{nd}$ medium 208 for $Z_2$ 211 can be estimated by knowing the 1st medium 207 impedance $Z_1$ 210 through the Equation (1-1). Then, based on the value of $Z_2$, the bond condition and cement quality can be evaluated. It is a reliable method to use the acoustic wave propagation reflection method for the case of regular cement since the impedance difference between borehole fluid, such as water, and regular cement is high. However, the acoustic impedance of LWC is close to the one of the borehole fluids, which makes the reflection method mentioned above based on Equation (1-1) for evaluating LWC bond condition and cement quality behind the casing, with or without tubing presence, inaccurate.

$$\theta_r = \theta_i \tag{1-0}$$

$$R = \frac{I_1 R}{I_1} = \frac{Z_2\cos(\theta_i) - Z_1\cos(\theta_t)}{Z_2\cos(\theta_i) + Z_1\cos(\theta_t)} \tag{1-1}$$

$$D = \frac{I_1 D}{I_1} = R + 1 = \frac{2Z_2\cos(\theta_i)}{Z_2\cos(\theta_i) + Z_1\cos(\theta_t)} \tag{1-2}$$

Figure 3A:
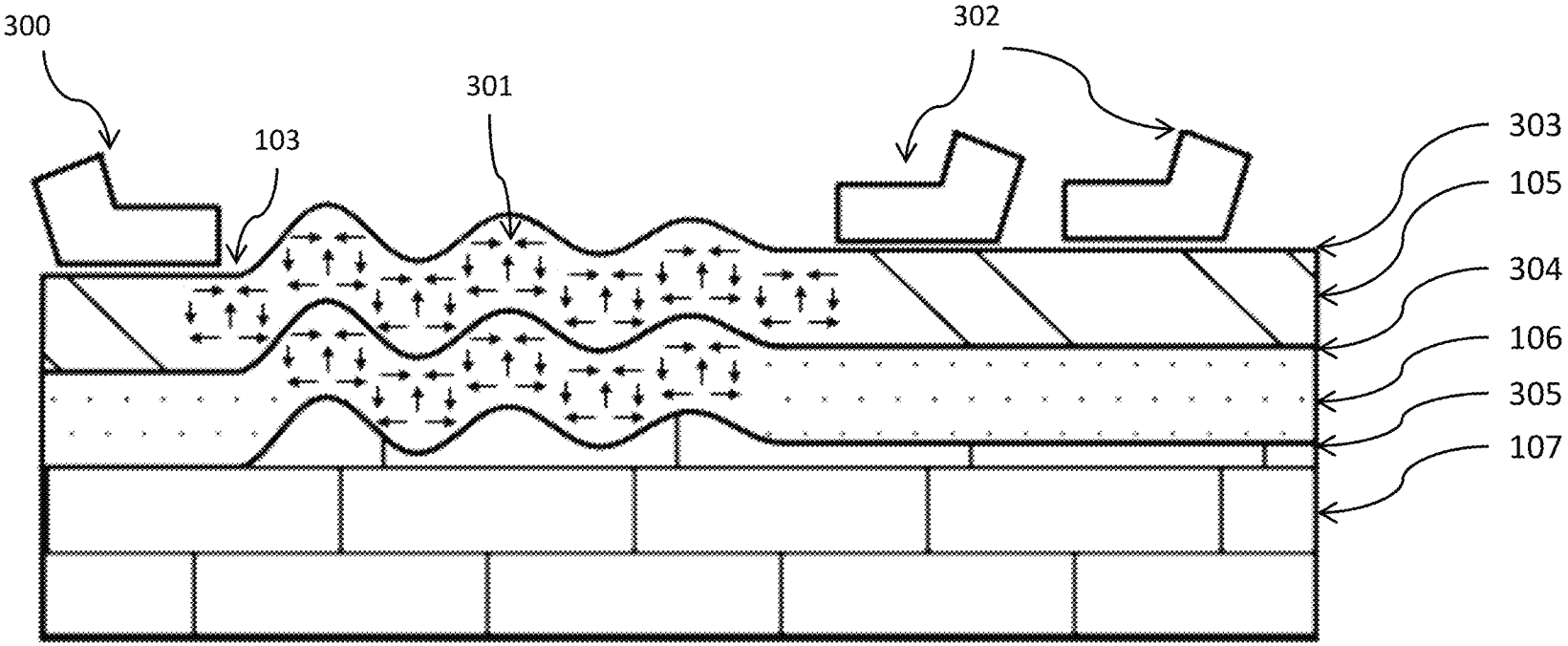
FIG. 3*a* illustrates wave propagation attenuation method using L-wave for LWC bond evaluation according to prior art.

FIG. 3*a* represents the side view of the concept illustrating a prior art apparatus that uses the acoustic wave propagation and attenuation method to evaluate the bond condition of LWC behind a single pipe (casing). The method relies on an acoustic transmitter 300 and two receivers 302 installed along the axis of the casing. The acoustic transmitter 300 generates a P-wave in borehole fluid that induces Lamb waves 301 through the first casing interface 303 with a certain incidence angle given a selected frequency in asymmetric mode (A-mode) so called flexural mode that propagates through the body of the casing as an acoustic wave guide. The attenuation of the A-mode wave is highly affected by the amount of energy coupled through the cement bond interface into the cement. The acoustic A-mode body wave with the elliptic displacement motions of the casing particles along the wave propagation creates the acoustic energy coupling mechanisms, which can be projected into compressional displacement motion and shear displacement motion, across the interface 304. Governed by the Equation (1-2), the portion of the compressional motion causes the acoustic wave A-mode 301 propagation energy diffracted into the cement across the interface 303 with the perpendicular angle ($\theta_i$=0) towards the interface 304, and similarly into the formation across the interface 305. The portion of diffracted acoustic energy as the energy loss will be shown as the wave propagation attenuation in the casing. However, the compressional P-wave diffraction across the interface is based on the material density differences of layers shared with the interfaces 304 and 305, respectively. For LWC, the density is close to the borehole fluid, as a result, the measurement of the energy attenuation caused by the compressional P-wave diffraction cannot be used for distinguishing the cement bond condition. On the other hand, the shear displacement motion also couples the acoustic energy across the interfaces 303 and 304 of the wave guide layers. The amount of energy coupled across the interfaces 303 and 304 depends upon the shear modulus of the material properties of layers. The higher the shear modulus of the material behind the casing, the more acoustic energy will be coupled into the material across interface 303. For borehole fluid, the shear modulus is zero. Therefore, the shear motion of the acoustic wave cannot be coupled across the interface when behind the casing is filled with borehole fluid. But for LWC, the shear modulus is nonzero. A certain amount of wave energy carried by the shear motion can be coupled into the LWC layer across the interface 303 as energy loss for the wave 301 propagating along the casing, which can be measured as the wave attenuation. So, the shear motion coupled energy loss across the interfaces 303 and 305, can be measured for the cement bond condition behind the casing. The attenuation of the acoustic wave measured by the receiver 302 can be used to determine the LWC condition.

Figure 3B:
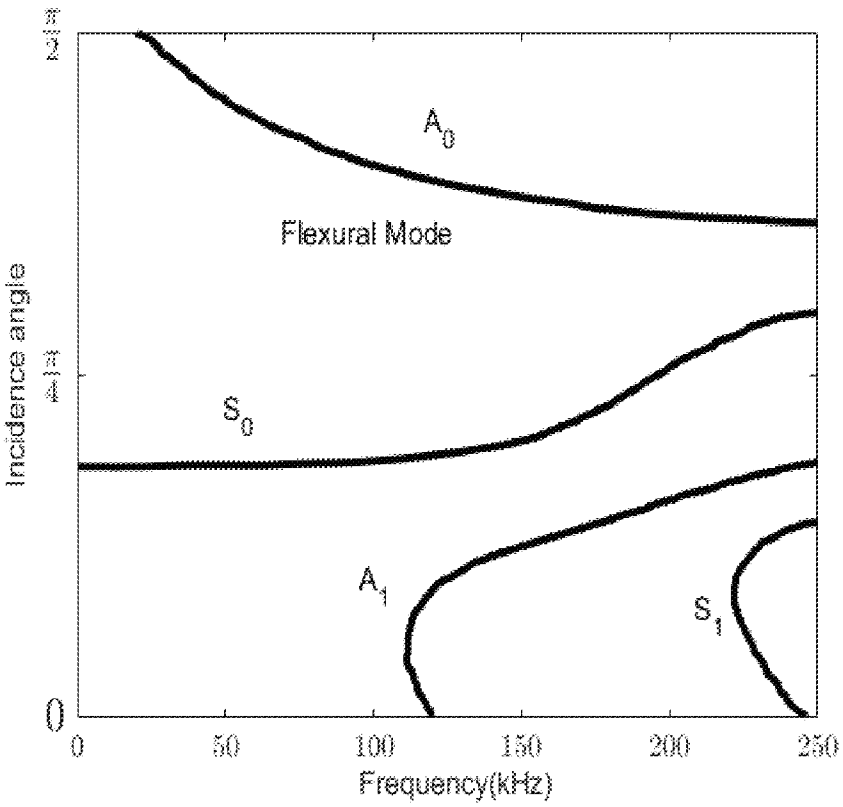
FIG. 3*b* is the plot for flexural mode L-wave incident angle vs. frequency, as known in the art.

FIG. 3*b* shows the relationship between the flexural A-mode Lamb wave incidence angle and frequency. The acoustic frequency is determined by the geometry and properties of the steel pipes. When Lamb wave is used for as shown in FIG. 3*a*, the incidence angle $\theta_i$ shown in FIG. 2 shall follow the relationship shown in FIG. 3*b*. That is the reason why the transmitter on FIG. 3*a* has unique shape in order to maintain the incidence angle given certain operation frequency (normally in tens of kHz in frequency) so that the A-mode Lamb wave can be induced into the casing 105 on FIG. 3*a*. Arbitrarily changing the incidence angle will greatly reduce the Lamb wave energy coupled into casing.

Figure 3C:
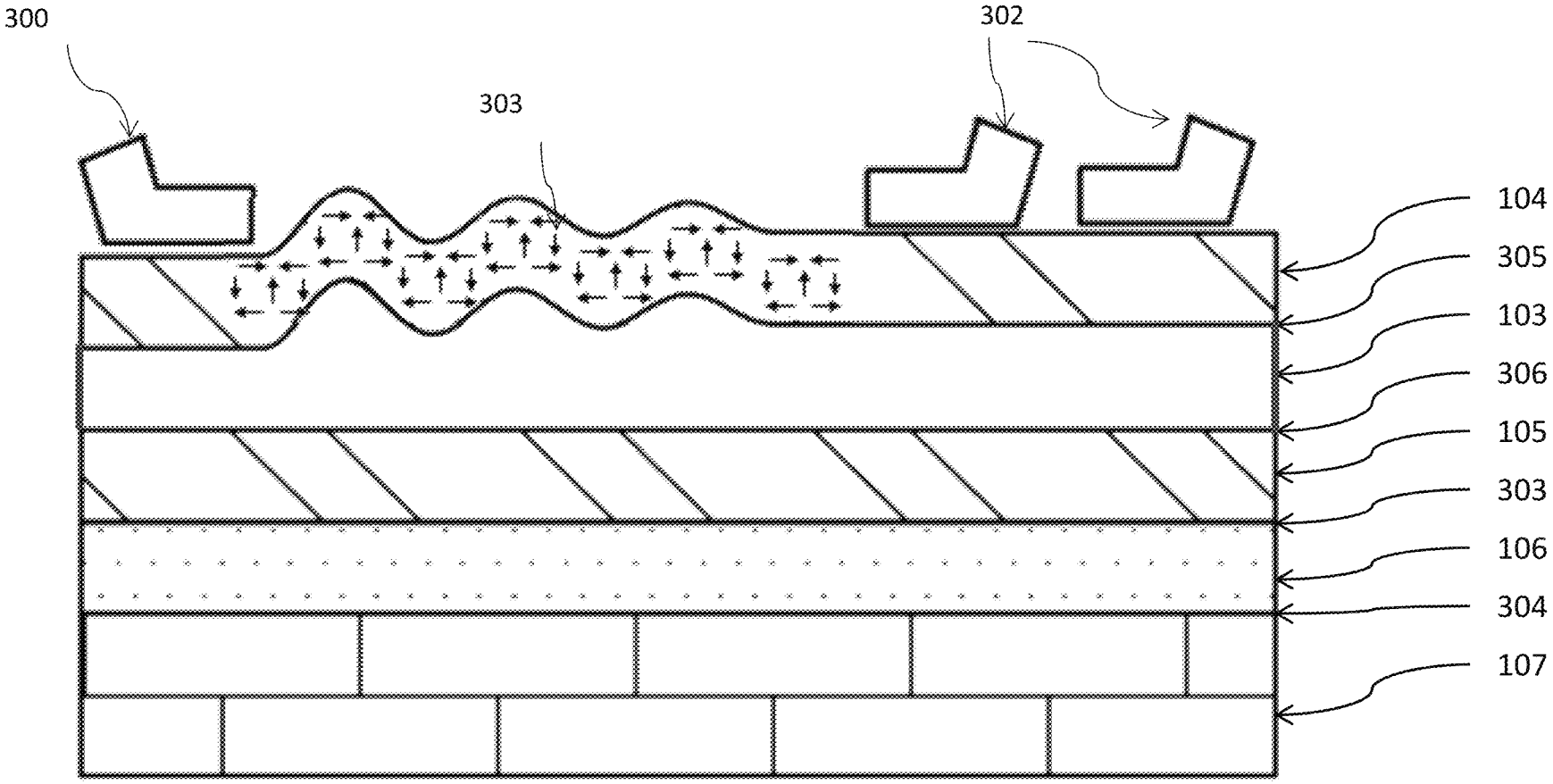
FIG. 3*c* displays the limitation and challenge of L-wave method in the presence the tubing, as known in the art.

FIG. 3*c* is also the side view of the concept that describes the effect of introducing the tubing in the method illustrated in FIG. 3*a*. Once the tubing is inserted inside the casing, the fluid layer, and the interfaces 305 and 306 are formed behind the tubing and before the casing. Due to the fact that the large difference of acoustic impedances in between the fluid and the tubing as well as the casing, made from steel pipe, according to the Equation (1-2), only about 16% of the acoustic wave energy can be diffracted across a single steel-fluid interface. So, then the two new interfaces, 305 and 306, will introduce four times additional diffractions for the round-trip acoustic wave propagations, which generates roughly −35 dB to −50 dB in SNR reduction for the acoustic wave energy propagation. Eventually, the reflected signal carrying the cement bond condition information will go through multiple diffraction processes and be received by the receivers 302 for cement bond measurements. Only the portion of the acoustic wave signal that touches the cement and is reflected from the casing-cement interface 303 carries the information of the cement bond condition. After that, the portion of the acoustic signal has to go through the interfaces 306 and 305, sequentially, controlled by the diffraction process shown in Equation (1-2). Therefore, the total round trip from the interfaces 305 and 306 causes acoustic wave energy loss in the range of −36 dB to −50 dB as mentioned above, making the sensitivity and SNR of the acoustic measurement method is very low and becomes an unreliable measurement method in real applications. In addition to the heavy acoustic energy loss due the round-trip diffractions, the extra interfaces 305 and 306 may change the incidence angle on the interface 306 that could be different from the original incidence angle for inducing the A-mode Lamb wave from the transmitter 300 to the tubing. As a result, almost no Lamb wave can be excited in the casing. So, as described in FIG. 3*a*, the A-mode Lamb wave propagation method is not applicable when an LWC layer presents behind the casing.

Figure 3D:
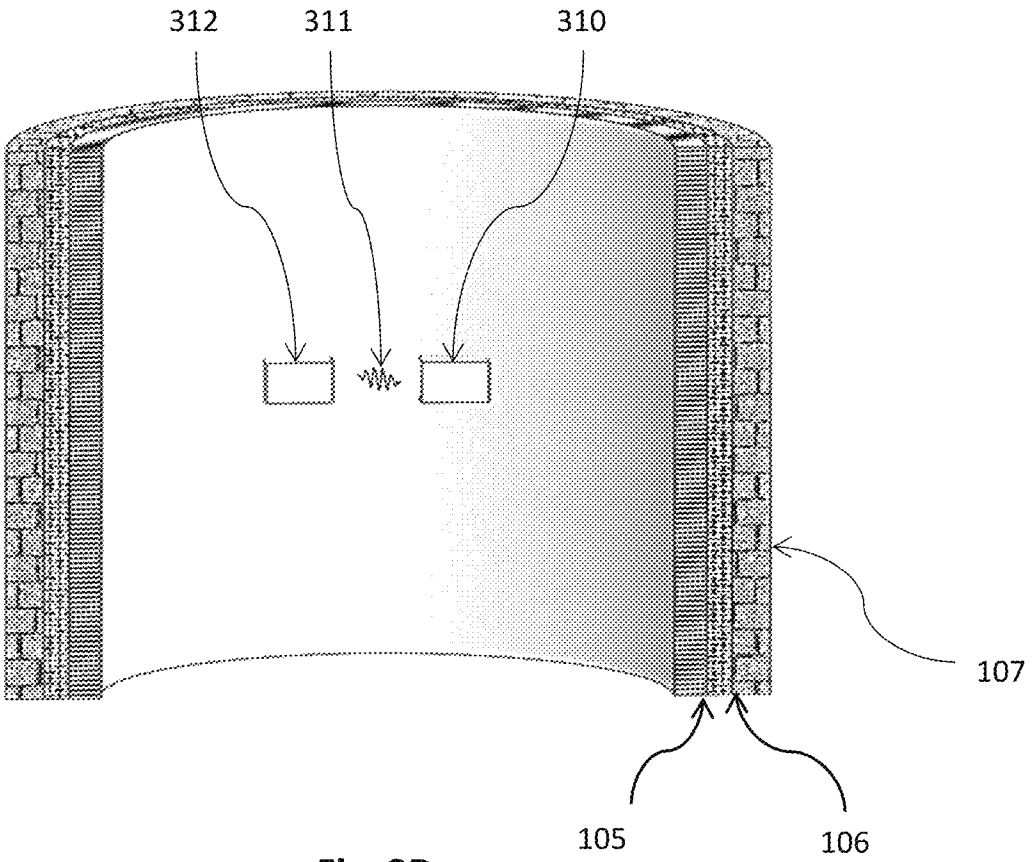
FIG. 3*d* illustrates the wave propagation attenuation method using S-wave for LWC bond evaluation according to prior art.

FIG. 3*d* shows acoustic shear wave (S-wave) propagation attenuation method to evaluate the LWC bond behind casing 105. The method includes inducing by a transmitter 310 a transversely polarized S-wave 311 into casing 105. The acoustic S-wave 311 is then measured by a receiver(s) 312. The LWC with a good bond condition presents a measurable shear modulus which can couple the S-wave 311 from the casing 105, proportionally, into the cement 106, and further into the formation 107. The amount of attenuation of the S-wave 311 propagation from the transmitter 310 to the receiver 312 can be used for evaluation of casing-cement bond situation. Once the casing-cement separated (debonded) and/or cement fractured, the borehole fluids would invade into the gaps in between the outer surface of casing 105 and inner surface of the cement 106, as well as the cavities of cement 106. Fluids do not have the shear modulus property and thus cannot be used for coupling and propagating S-wave into cement 106 and, further, into formation 107. Therefore, much less attenuation, compared to the fully bonded in between casing 105 and cement 106, would occur during the S-wave 311 propagation from the transmitter 310 to the receiver 312. Therefore, measuring the S-wave propagation attenuations can be used for evaluating LWC bond conditions.

Figure 3E:
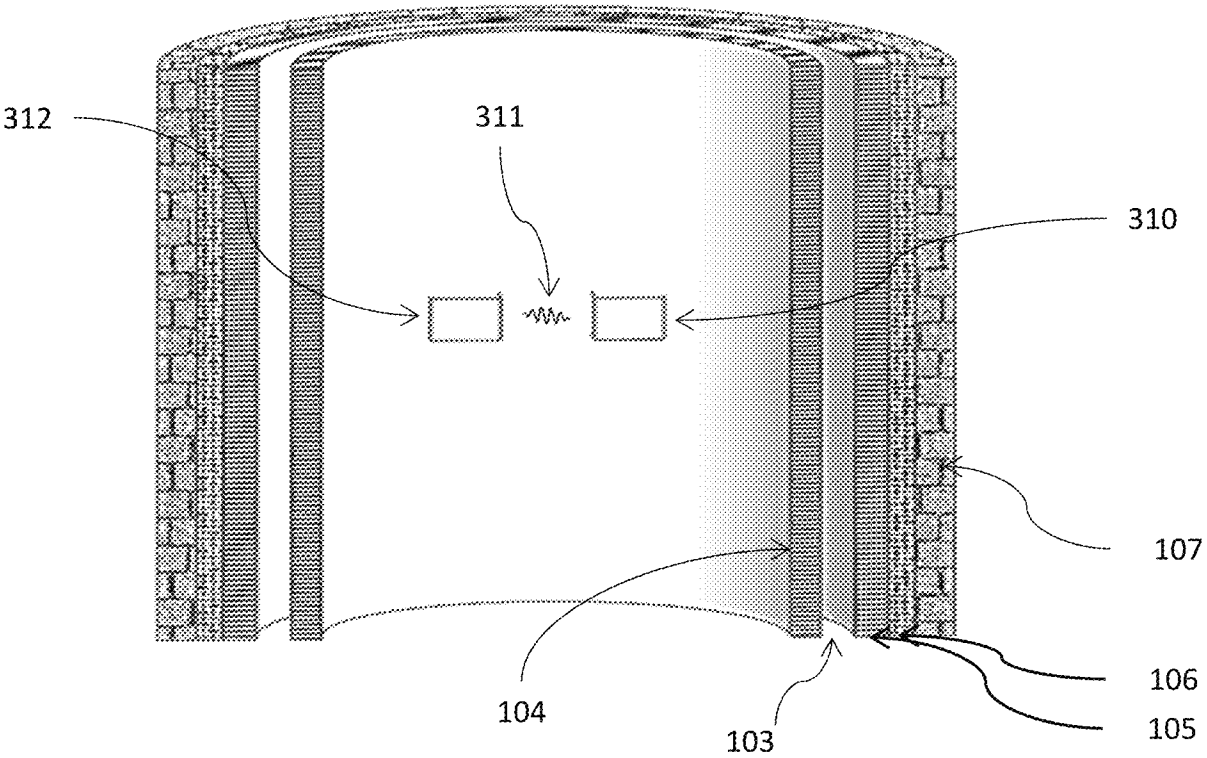
FIG. 3*e* shows the limitations and challenges with the S-wave method in the presence of the tubing, according to prior art.

FIG. 3*e* shows the main challenge for the S-wave propagation attenuation method, discussed in FIG. 3*d*, wherein tubing 104 is inserted inside the casing 105 with the annular space 103 formed and filled with borehole fluids. The fluid layer 103 behind the tubing 104 does not have shear modulus that can couple S-wave 311 into the fluid layer 103 and, further, into the casing 105. Therefore, the S-wave 311 propagation attenuation method cannot be used for evaluating the cement bond condition for any types of cement, including LWC.

Figure 4:
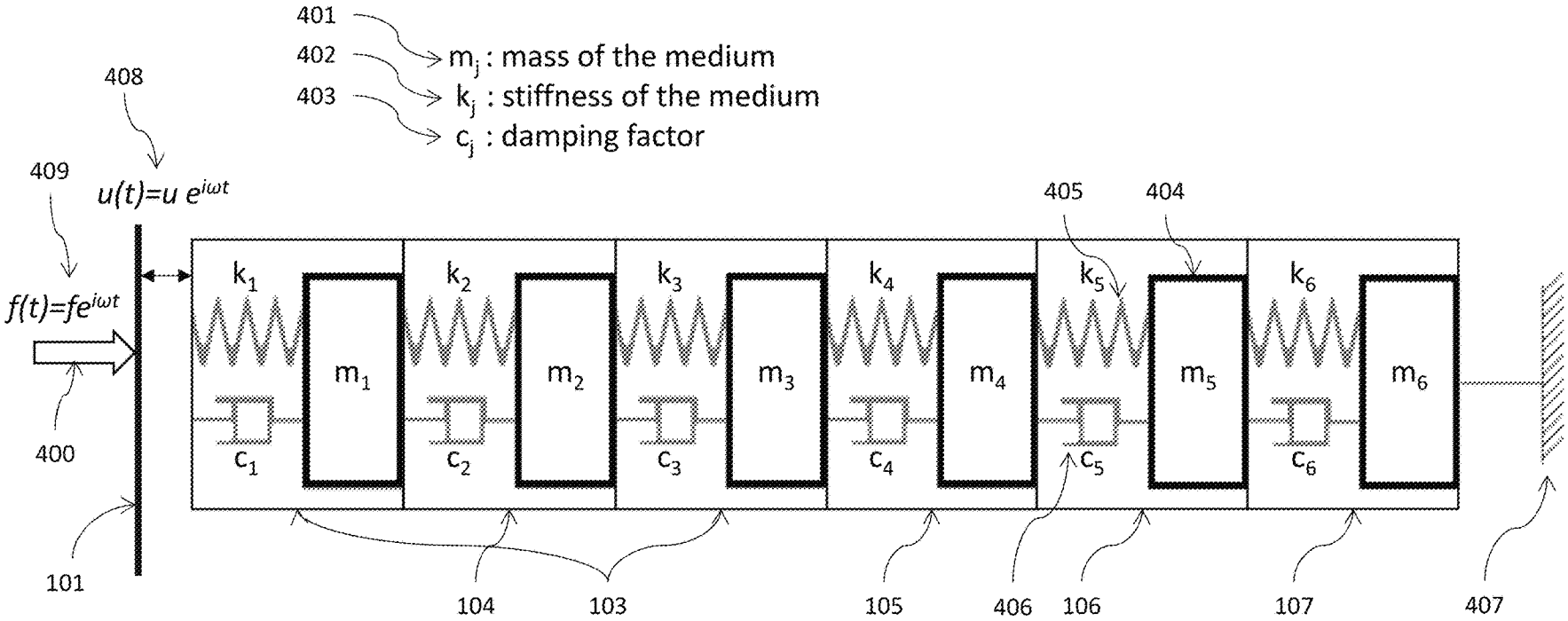
FIG. 4 illustrates a 1-D elastic structure model for a production well with the through tubing, according to an exemplary embodiment of the present invention.

FIG. 4 is a schematic diagram illustrating an implementation of the disclosed method for evaluating cement bond condition in downhole using nonharmonic resonance method. The disclosed apparatus includes a tool string that can be lowered into the casing without the tubing or can be lowered in the tubing, as shown in FIG. 1. The tool sting can include a segmented transducer ring matrix that can continuously excite the surrounding medium to cause vibrations in any elastic structure, such as the casing 105. FIG. 4 shows a 1-D diagram for elastic structure model of a production well with tubing that is being excited by the disclosed segmented transducer ring matrix. The production well is assumed to be a multi-degree of freedom (M-DOF) system excited by a force 409 generated by the disclosed tool string. The various layers of the production well 100, as shown in FIG. 1, are illustrated as a chain with 101, 103, 104, 103, 105, 106, 107, and 407 elements connected though solid mechanics and/or fluid pressure to be able to transfer mechanical force from the disclosed tool string 101, through the chain of different structure layers, eventually to the formation 107 and absorbed entirely by the nonreflective boundary condition 407. In the model, every medium layer in the chain is modeled and simulated as a rigid body having a mass $m_j$ 401, for example 404 in layer 106, and its motion is coupled to the adjacent medium through a spring having stiffness $k_j$ 402, for example 405 in the layer 106, and a damper with a damping coefficient $c_j$ 403, for example 406 in the layer 106. The model shown in FIG. 4 is referred to herein as 1-D "kmc" block model. The index j represents various layers of material arranged in an order that corresponds to a typical production well with the tubing. The index j with value 1 is the layer between the disclosed tool string 101 and the tubing 104 of the production well. The index j with value 2 is the next structure and the value increments at each layer until it reaches 6 which is the formation 107. The values of $m_j$ 401, $k_j$ 402, and $c_j$ 403 depend on the mechanical property and the geometrical dimensions of each layer. So, the 1-D "kmc" block model becomes an elastic chain representing the elastic structure of the production well 100, shown in FIG. 1. Then, the nonharmonic resonance modes of the elastic "block chain" vibrations can be studied to predict the behaviors and characteristics of the production well 100 for LWC estimations and evaluations.

Unlike wave propagation method, the disclosed apparatus can excite the downhole system 100 with a continuous harmonic force 400 as shown in following:

$$f(t)=f\,e^{i\omega t} \tag{2-0}$$

where f is the amplitude of the mechanical force, ω denotes the excitation frequency, and i is imaginary unit. This excitation frequency ω can be either swept or maintained constant depending on the application. The resulting stationary displacement u(t) 408 at the surface of the tool string 101 vibrates with same frequency ω. The tool string 101 may also generate a force 400 with multiple frequencies $$f(t)=\Sigma_{j=0}^{N} f_j e^{i\omega_j t} \tag{2-1}$$

leading to a displacement 408 having a linearly steady state vibration with same frequencies $$u(t)=\Sigma_{j=0}^{N} u_j e^{i\omega_j t} \tag{2-2}$$

This displacement carrying the mechanic vibration energy is coupled sequentially into the different layers and undergo gradual energy attenuations, and eventually getting into the formation 107 and reaching 0 inside the formation's end as the nonreflective boundary condition 407. The Fourier transform F(ω) of the excitation force 400 in Equation (2-1) and resulting displacement U(ω) in Equation (2-2) in Fourier Transform are related by Frequency Response Function (FRF) H (ω) as shown in equation (3) as $$U(\omega)=H(\omega)F(\omega) \tag{3}$$

The FRF coefficient depends on mechanical properties, geometric dimension, and boundary condition of each layer modeled as the "kmc" block chain. Once the LWC bond condition changes in between the casing 105 and the cement 106 and/or the bulk density changes of the cement 106, the FRF shall be different from the FRF for the condition of the regular cement or LWC 106 fully bonded to the casing 105. The FRF reaches its local maximum as a "peak" once the frequency of the vibration excitation force 400 matches one of the natural resonance frequencies of the elastic structure "chain" of the downhole system 100. The resonance frequency has a corresponding mode shape that defines the deformation of each element of the structure while vibrating at that resonance frequency. The highest change of the FRF due to a change of LWC properties and bond condition happens when the excitation frequency ω is equal to the resonance frequency with mode shape inducing the maximum displacement at the LWC layer. The multiple resonance frequencies and mode shapes corresponding to the number of DOF for both resonances and anti-resonances exist in the elastic "kmc" block chain. This relationship of the resonance frequencies including all resonance mode shapes is nonharmonic since no integer factors exist among the resonance frequencies. The magnitudes and phases of the resonances and the resonance frequencies are determined by the "kmc" block property values. Therefore, the mechanical resonance impedance and resonance frequency "peak" drift of certain mode shape(s) can be used for measuring and evaluating the LWC conditions with or without tubing 104 inserted inside casing 105. In general, the mechanic vibration dynamics for j-th "kmc" block can be described in Duffing Equation in following and so called "Duffing Oscillator", $$m_j\frac{d^2u_j(t)}{dt^2}+c_j\frac{du_j(t)}{dt}+k_ju_j(t)+\beta_ju_j^3(t)=f_je^{i\omega t} \tag{4}$$

where $\beta_j$ is the impact factor of the property nonlinear behavior of the j-th "kmc" block. For small magnitude of the displacement $u_j(t)$, the Equation (4) can be approximated into a linear model by assuming $\beta_j$ is zero.

Figure 5:
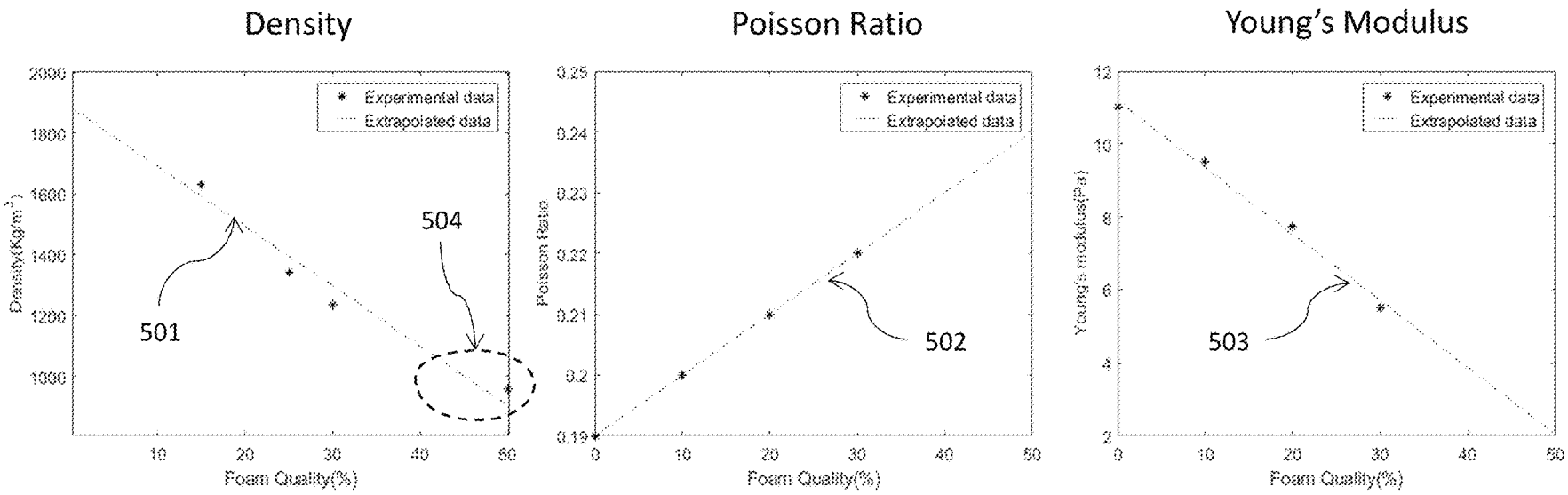
FIG. 5 illustrates the variation of the LWC properties as a function of the foam quality.

FIG. 5 shows the "kmc" block property values in Density, Poisson Ratio, and Young's Modulus for LWC made from nitrogen volume percentage as Foam Quality (FQ %) in the cement layer 106 in FIG. 4. Unlike standard cement, LWC is made of cement slurry mixed with nitrogen foam (FQ %) to reduce its density 501. In some cases, the density of LWC is close to or even below the borehole fluid density, shown in the region 504. However, the significant differences exist in Poisson Ratio 502 for LWC in the range from 0.25 for regular cement to 0.19 for LWC high in FQ (%) compared to the borehole fluid for 0.5. Similarly, the Young's Modulus 503 for LWC in FQ (%) is from 11 to 2 GPa while the borehole fluids do not have Young's Modulus values but Bulk Modulus 2.2 GPa. The natural resonance frequencies of the "kmc" elastic chain model are determined by the combinations of the elasticities, densities, and dumping factors in the chain. And the elasticities come from the values of young's modulus and Poisson Ratio. So even when the Density of LWC in high FQ (%) range are close to the density of the borehole fluids to make it difficult to distinguish, it is highly possible to separate LWC from borehole fluids using resonance method where the resonance mode differences can be measured due to the significant differences in Young's Modulus and Poisson Ratio in between LWC and borehole fluids with or without the tubing 104 inserted, which is a challenge for wave propagation methods.

Figure 6B:
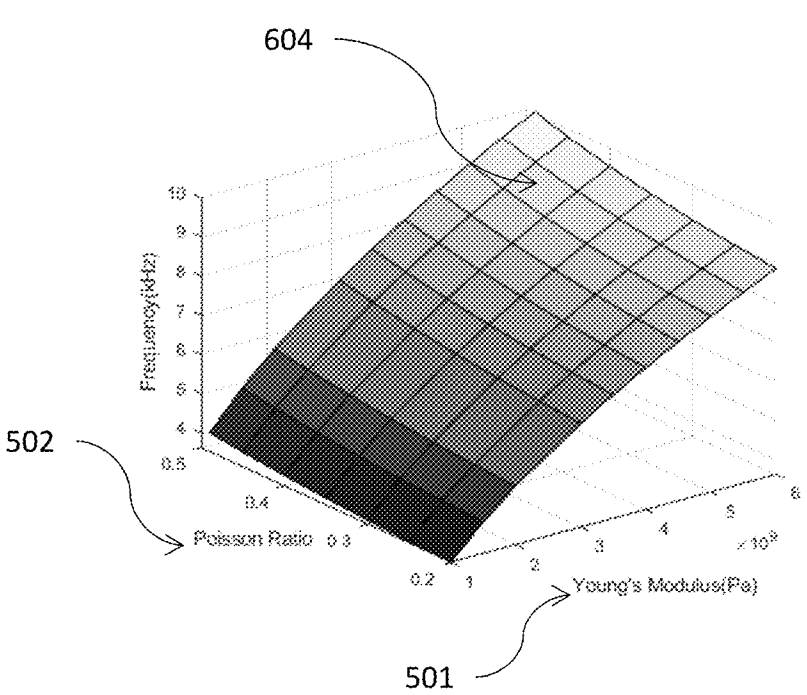
FIGS. 6*a* and 6*b* illustrate the mode shape behavior and the frequency response of an example of circular annulus as a function of the Young's Modulus and Poisson Ratio.
Figure 6A:
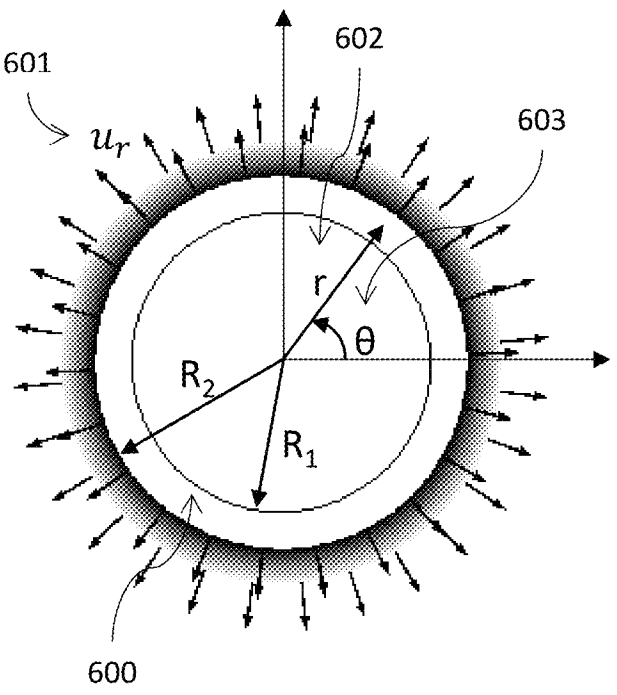

FIG. 6 (*a*) displays the first radial mode shape of a solid annular ring object 600 having an inner radius $R_1$ and outer radius $R_2$ under harmonic vibration, which is configured in an axisymmetric format. The mode shape is a function of the radial coordinate r 602, mechanical properties of the object 600, and the boundary condition. From Equation (4), the radial displacement $u_r$ 601 at each point inside the object 600 under harmonic vibration with a frequency ω shown in Equation (2-0) is derived as Equation (5-0) in following. The displacement $u_r$ 601 at the edges depends on the boundary condition and governed by equation (5-1) and (5-2).

$$\frac{d}{dr}\left((1-\nu)\frac{du_r}{dr}+\nu\frac{u_r}{r}\right)+(1-2\nu)\left(\frac{du_r}{dr}+\frac{u_r}{r}\right)=-\omega^2\rho\frac{(1-2\nu)(1+\nu)}{E} \quad (5\text{-}0)$$

$$u_r(r=R_1)=u_{r_1} \quad (5\text{-}1)$$

$$u_r(r=R_2)=u_{r_2} \quad (5\text{-}2)$$

where, ρ is the density, E is the young's modulus, ν is the Poisson Ratio, and ω is the vibration frequency of the object 600. The magnitude of displacement $u_r$ 601 and the resonance frequency 604 at which $u_r$ 601 reaches its maximum are determined with the mechanical properties of the object 600 and the boundary conditions at the inner radius $R_1$ and outer radius $R_2$. FIG. 6(*b*) displays the behavior of the resonance frequencies 604 as function of Young's Modulus 503 and Poisson Ratio 502 as shown in FIG. 5. FIG. 6(*b*) shows the simulation results of Equation (5-0) in which an increase of Youngs Modulus 503 and/or Passion Ratio 502 of the object 600 yields an increase of the natural resonance frequency of the object 600 given fixed inner radius $R_1$ and outer radius $R_2$, as well as the density in the range of LWC, the same as one for the water. These graphs indicate that any modifications in the LWC properties due to cement damage or/and downhole fluid migration results in a change of the system resonance frequency 604 and the displacement amplitude 600. Similarly, any change in the bond condition between the casing 105 and LWC or the LWC and formation 107 will affect the boundary condition at the LWC and thus modify its resonance frequency as shown in equations (5-1) and (5-2). Therefore, the nonharmonic resonance method is cable of evaluating the LWC with/without tubing 104 insertion and its bond condition based on resonance frequency detections and total energy amplitude determinations.

Figure 7:
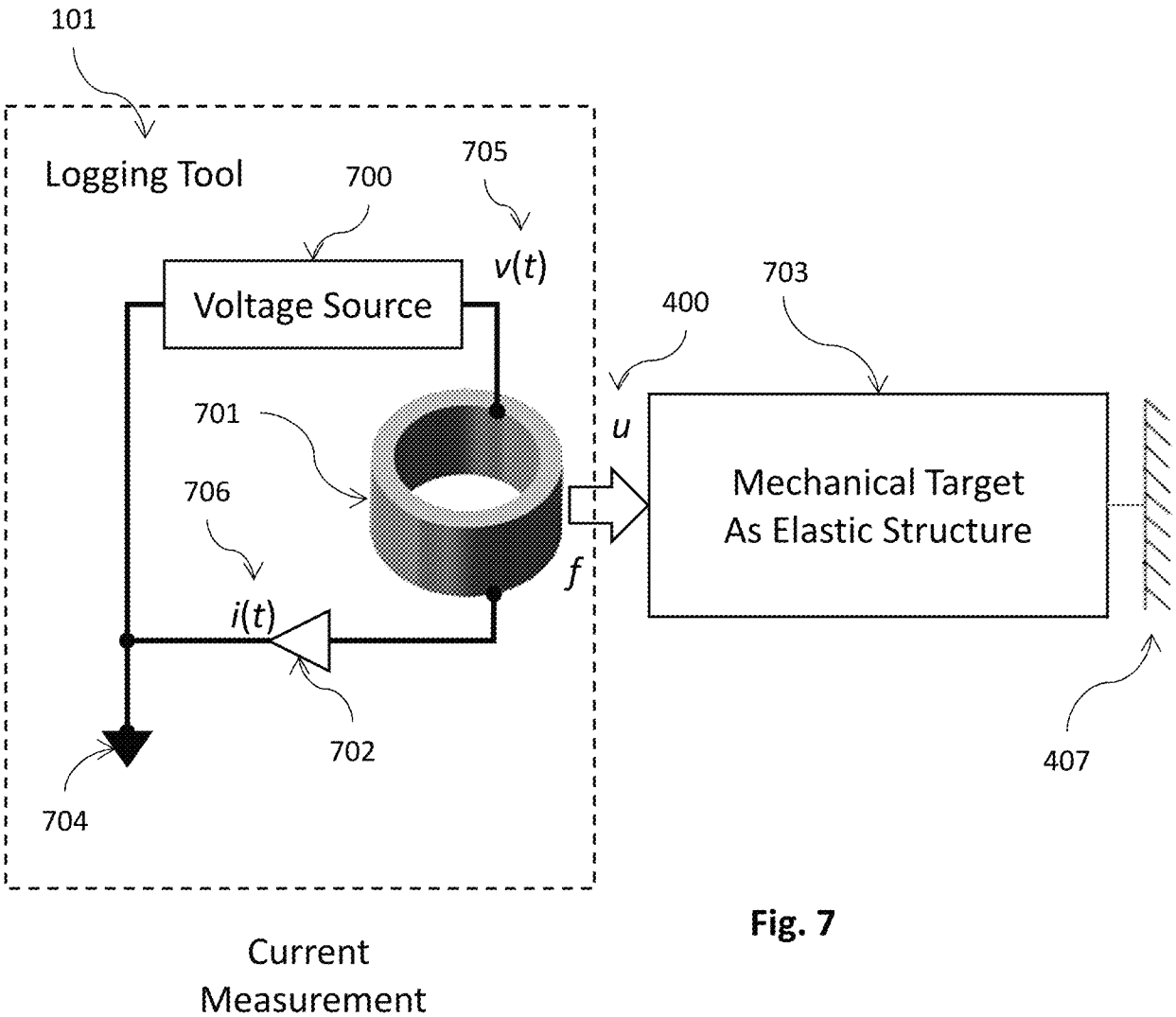
FIG. 7 shows an exemplary embodiment of impedance measurement circuit of the disclosed apparatus. The piezo transducer is driven by a voltage source at a specific frequency to actuate pre-selected one or more mode shape resonances. The driving current is measured and processed.

FIG. 7 illustrates the impedance measurement circuit used by disclosed apparatus to determine the LWC bond condition. This circuit measures the total excitation energy transmitted into the multi-pipe mechanical elastic structure 703 including from 103 to 107 shown in FIG. 4, as well as the vibration frequency spectrum covering the predefined range of the resonance mode shapes where one or multiple nonharmonic resonances and anti-resonances may present. The measurement circuit of the tool string 101 is made of one of more designed monopole piezoelectric cylindrical transducer ring(s) 701 connected in parallel to a voltage source 700 and current measurement circuit 702. The transducer 701 is radially polarized and may have a natural frequency close to one the resonance frequency of the structure 703 to increase the efficiency of transmitted mechanical energy. The voltage source 700 can be controlled in the frequency and amplitude of the output voltage signal. The voltage source 700 excites the piezoelectric transducer 701 with a selected frequency and/or sweeps the predefined frequency range. Once the transducer 701 is actuated, it vibrates in the radius monopole (MP) mode with the same frequency. The vibration displacement energy $u_r$ 400 is coupled from the transducer 701 into the target structure 703.

As mentioned above, the transducer 701 may contain multiple transducer rings with the same natural frequency connected in parallel to the voltage source to enhance the total amount of mechanical energy transmitted with high efficiency and high MP mode purity. A matrix of transducer rings 701 with various natural frequencies may also be used to cover multiple mode shapes of resonance frequencies. A complex current measurement 702 circuit is installed between the transducer 701 and the signal ground 704 to estimate the amplitude and phase of sinusoidal electrical current traveling through the transducer matrix 701. Then the measured current can be sampled and processed by digital processing (processing module) using Ohm's Law to estimate the electrical input impedance of the transducer matrix 701 directly loaded (coupled in series) with the target structure 703 in which LWC bond condition is included. The impedance measurement value is proportional to the mechanical impedance of the target structure 703 during the vibrations due to the direct coupling connection in series from the transducer electrical impedance to the structure mechanical impedance of the target 703 where the piezoelectric cylindrical transducer matrix 701 plays the energy transferring and exchanging role (coupling) in between the electrical domain and the mechanical domain. Further processing is needed to extract one or more mode shapes of resonances in terms of amplitude, phase, and frequency to evaluate the LWC bond conditions with or without the insertion of the tubing 104 inside the casing 105 shown in FIG. 4. The coupling behavior of the piezoelectric transducer matrix 701 between the electrical input and mechanical output under harmonic excitation with a frequency ω is described in Equations (6-0) and (6-1), which is related to the Fourier transforms, U(ω) and F(ω), of the transducer displacement u(t) 408 and applied force f(t) 400, respectively, with the Fourier transform, V(ω) and I(ω) of the input voltage v(t) 705 and the input current i(t) 706, respectively, with linear expressions using the piezoelectric natural frequency $\omega_p$, damping coefficient ζ, coupling coefficient θ, and capacitance $C_p$, $$(-\omega^2+2i\zeta\omega\omega_p+\omega_p^2)U(\omega)-\theta V(\omega)=F(\omega) \quad (6\text{-}0)$$

$$i\omega\theta U(\omega)+i\omega C_p V(\omega)+I(\omega)=0 \quad (6\text{-}1)$$

By combining Equations (3), (6-0), and the continuities of the boundary conditions in Equation (5-1) and (5-2), the mechanical vibration energy will be coupled further into the next adjacent "kmc" layer causing its vibration governed by Equation (3) and (5-0). The process will be going on all the way to the last "kmc" layer and, eventually, into boundary 407, shown in FIG. 4. So, the entire target structure layer "kmc" chain vibrations are linked together to form various mode shapes. The processing is linked and coupled together from the driving voltage source, frequency, current on the transducer to the entire target structure in the sense of mechanism and dynamics.

The driving voltage and current follow the Ohm's Law in Equation (7), $$V(\omega)=Z_e(\omega)I(\omega) \quad (7)$$

where, the $Z_e(\omega)$ is the electrical input impedance that can be decomposed into the in-phase and quadrature components shown in Equation (8) as following, $$I(\omega)=I_I(\omega)+I_Q(\omega) \tag{8}$$

And the measurement of $Z_e(\omega)$, corresponding to the mechanical displacement $U(\omega)$ 408 and force $F(\omega)$ 409 that are applied on the block chain of the target system 703, can be used to estimate and evaluate the LWC cement bond condition. In case of a fixed voltage 705 amplitude as the known voltage $V(\omega)$ driving the transducer 701 across excitation frequencies, the variation of the current $I(\omega)$ is inversely proportional to the variation of the electrical impedance $Z(\omega)$ as shown in Equation (7) and can be decomposed into in-phase and quadrature components, current $I_I(\omega)$ and current $I_Q(\omega)$, shown in Equation (8). In principle, the in-phase part $I_I(\omega)$ is proportional to the amount of active power "consumed" including being damped inside the "kmc" block chain in the target system 703 and the portion of the structure vibration energy coupled into the formation and absorbed in the boundary 407 through the all the interfaces including the casing-cement interface and the cement-formation interface, while the quadrature part $I_Q(\omega)$ represents the energy storage and transformation in between the mechanical format in the transducer 701 as well as the target structure 703 and the electrical format in the driving circuit voltage source loop 700. The measurement of in-phase $I_I(\omega)$ at the selected mode shape will indicate the amount of mechanical energy passing through the casing-cement interface and cement-formation interface, which can be used to estimate the casing-cement bond conditions. The quadrature $I_Q(\omega)$ at the same mode shape also indicates the "rigidness" of cement mechanical supporting condition at the casing-cement interface for the cement bond evaluation. By combing both measurements, the LWC bond condition at the interfaces from the casing-cement as well as the cement-formation.

Figure 8B:
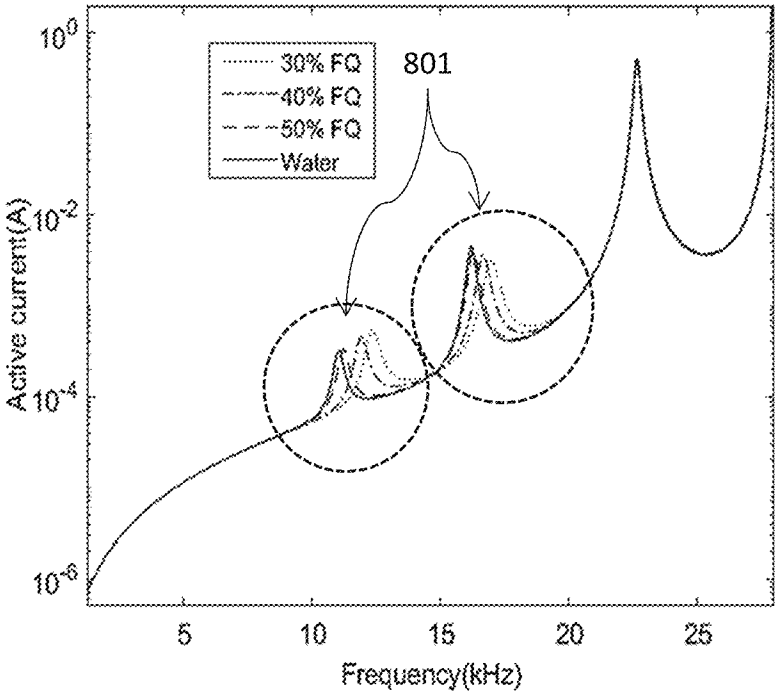
FIGS. 8*a* and 8*b* display the frequency responses of the current outputs for different foam qualities given the fixed driving voltage. It displays the multiple-modal Duffing nonharmonic resonance behaviors of the system displayed in FIG. 1.
Figure 8A:
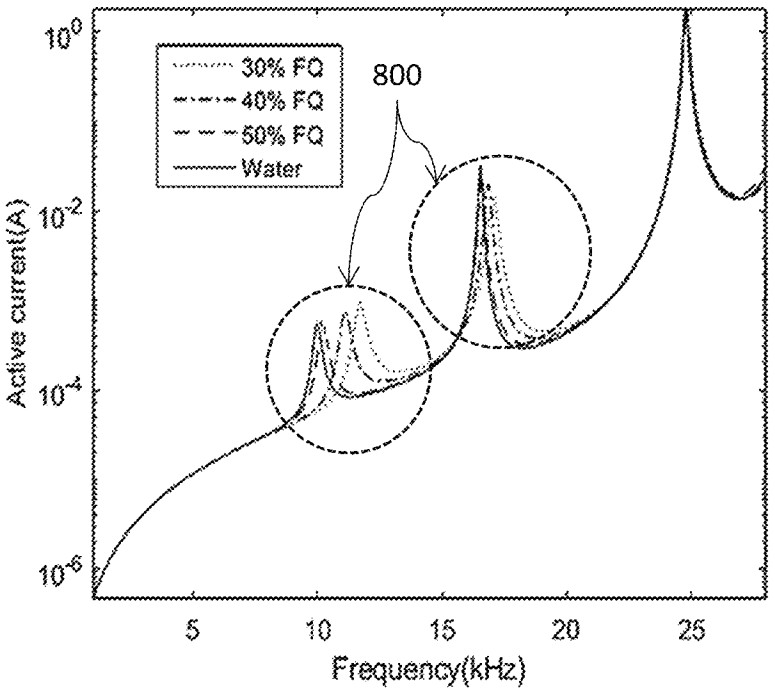

FIG. 8(*a-b*) shows the simulation results for LWC bond condition in-phase $I_I(\omega)$ responses using the measurement method described in FIG. 7 for with and without tubing 104 insertion. The simulation cases cover the range of LWC FQ (shown in FIG. 5) in the cement layer 106 from with water behind casing called "free pipe", to 50% FQ and 50% cement, to 40% FQ and 60% cement, to 30% FQ and 70% cement. The simulation frequency range is from 1 khz to 28 kHz in which two out of three resonance mode shapes 800 and 801 in between 7 kHz to 20 kHz show the detectible differences of the in-phase $I_I(\omega)$ on both (a) and (b) in terms of the magnitude changes and frequency shifts. The simulation results show the proof of the concept that the elastic structure nonharmonic resonance method can be used for measuring and evaluating LWC condition with and without tubing 104 insertion. In addition, the results show that the difference corresponding to the LWC FQ changes is more obvious in the first resonance mode shape around the frequency at 10 kHz than the one in the second resonance mode shape around the frequency 17 kHz, which indicates that the sensitivity of the first mode shape is higher than the second one's. There are no noticeable differences in the third mode shape around 23 kHz. The observations above are related to the mode shape associated with each of the resonance frequencies. Both (a) and (b) show the relatively similar profiles in curves, which indicates the elastic structure resonance behaviors (certain mode shapes related to the casing LWC bond conditions) are kept the similar except for the lower magnitude and nominal resonance frequency in water case in between with and without tubing 104 presence. So, the introduction of tubing 104 does not affect the mode shapes and or the overall trend of the current frequency response $I_I(\omega)$ as function of the material properties. Unlike the acoustic wave propagation method, the elastic structure nonharmonic resonance method can be used for TT-LWC evaluation.

Figure 9:
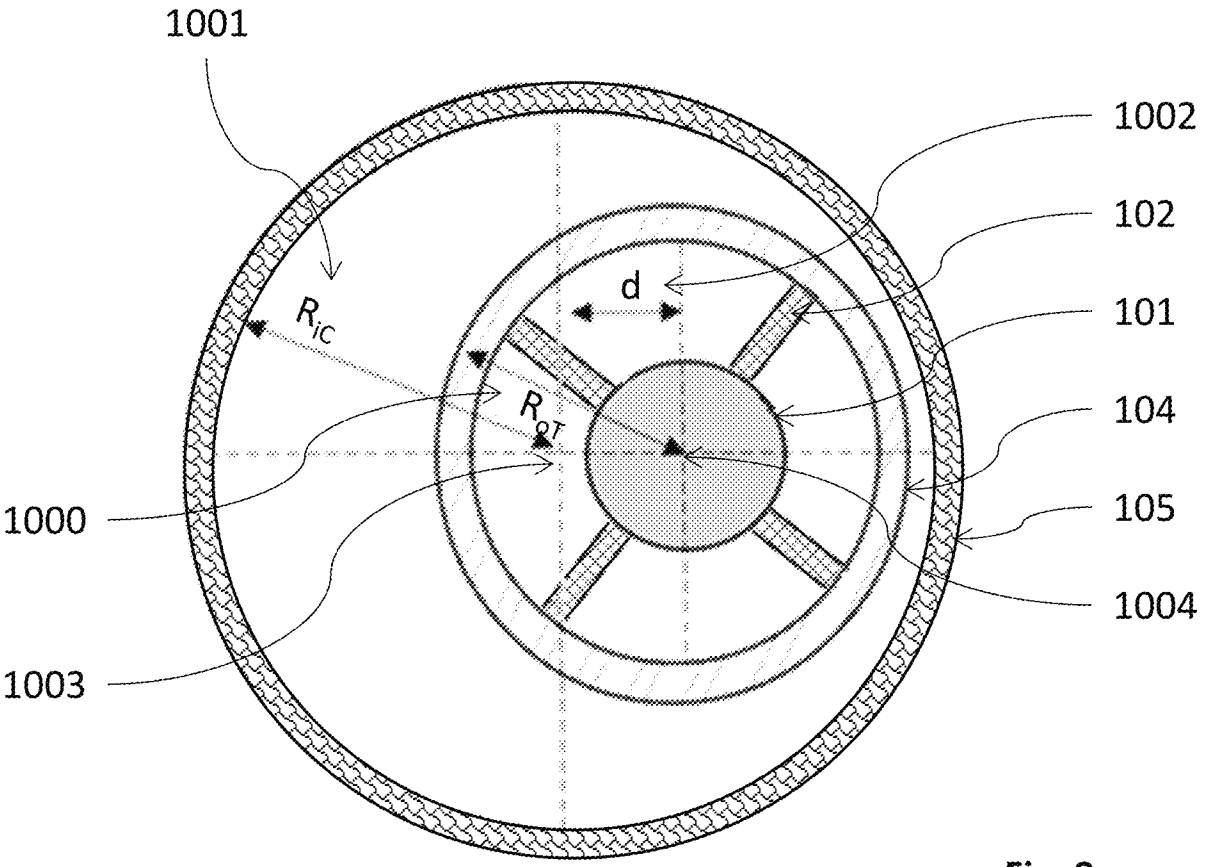
FIG. 9 is a top view showing an eccentric tubing positioned inside the casing and the tool string centralized relative to the tubing, according to an exemplary embodiment of the present invention.

FIG. 9 shows an example of tubing 104 decentralized inside casing 105. The centralization of the tool string 101 relative to the tubing 104 may usually be guaranteed with the centralizer 102, shown in FIG. 1. So, the lateral axis of tool string 101 and the lateral axis of the tubing 104 are overlapped labeled, the axis 1004. Tubing 104 may be decentralized inside to the casing 105 as shown in FIG. 9 for various reasons such as well deviation, gravity, tubing pipe string tension, etc. This eccentricity occurs when the distance d 1002 between the tubing lateral axis 1004 and the casing lateral axis 1003 is nonzero. The eccentricity coefficient, usually described as ECC, is the ratio of the distance of d over the nominal annulus gap in between of the radius $R_{iC}$ 1001 of the casing 105 inner surface and the radius $R_{oT}$ 1000 of the tubing 104 outer surface, as shown in Equation (9).

$$ECC = \frac{d}{R_{iC} - R_{oT}} \tag{9}$$

In the presence of tubing eccentricity, the vibration of the downhole structure becomes unsymmetric cylindrical coordination, which results in changes in angular θ dimension in the behavior of FRF in Equation (3) and Equation (5-1) of the mechanical system 100 vibrations. In that case, the assumption of the symmetrical vibration in monopole mode (MP) excited by the monopole transducer 701 may not be true and used to accurately estimate the casing-cement bond condition including TT-LWC measurements in the presence of tubing eccentricity. The absence of radial symmetry makes the monopole excitation unevenly distributed azimuthally in the annulus gap between the tubing 104 and the casing 105. As the result, the current $I_I(\omega)$ measured by the monopole sensor 701 in FIG. 7 is affected by both LWC bond condition as well as the eccentricity of the tubing 104 to the casing 105, which makes the problem more complex to be solved for TT-LWC bond evaluation.

Figure 10A:
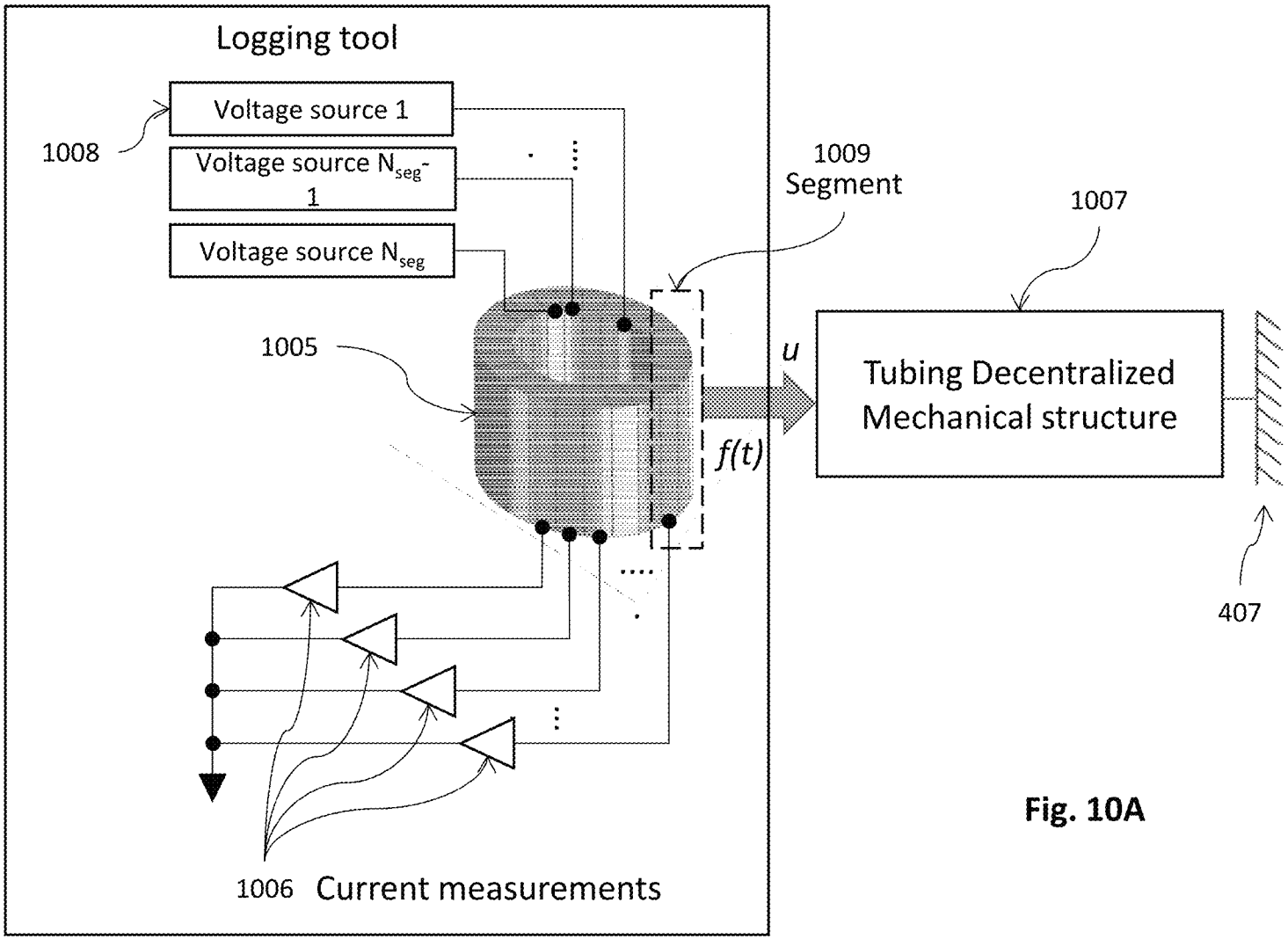
FIG. 10*a* and FIG. 10*b* illustrate a segmented transducer for LWC bond evaluation and tubing eccentricity evaluation and correction, according to an exemplary embodiment of the present invention. The apparatus includes multiple sensor segments that are excited with same driving voltage and their current outputs are measured and stored separately with independent current measurements circuits.

FIG. 10*a* illustrates the structure of the segmented transducer 1005, evolved from 701 in FIG. 7, and the measurement circuits 1008 and 1006 for TT-LWC evaluation when tubing eccentricity may occur. The polarization of each segment 1009 is configured in the way of the radial direction for the cylindrical segmented transducer array 1005. The resonance frequency $\omega_p$ of single segmented transducer array 1005 may be tuned within the frequency range of the target structure 1007 resonance mode shapes for the wide application range for various pipe sizes and thicknesses of tubing 104 and casing 105. Multiple segmented transducer arrays 1005 with different resonance frequencies $\omega_p$ yet with a fixed frequency interval among them can be constructed together along the lateral axis to form a transducer matrix to evenly cover the entire application frequency range. Each of the segments 1009 has its own separate electrodes and can be excited independently by a group of the voltage sources 1008. Or all segments 1009 can be combined in parallel and driven by a single voltage source 1008. However, each segment shall be connected separately to its own current measurement circuitry 1006. The current measurement $I_{i=1 \ldots N_{seg}}(\omega)$, shown in Equation (8), from each segment will be recorded. So, the impedance from Equation (7) for each segment can be estimated independently. The measured impedances in one predefined mode shape with the certain resonance frequency of the target structure 1007 from the segmented transducer matrix 1005 contains the responses of the overall TT-LWC conditions as well as the impact from the tubing 1004 eccentricity ECC, shown in Equation (9) and FIG. 9, inside the casing 105, shown in Equation (10), $$Z_i=\alpha_i Zcb_i+\beta_i Zecc_i \text{ wherein, } i=1, \ldots, N \tag{10-0}$$

When ECC=0, then, $$Zecc_i = 0 \text{ and } Zcb_i = \frac{\sum_{i=0}^{N} Z_i}{N\alpha_i} = \frac{Z_n}{N\alpha} \tag{10-1}$$

$$\text{Where, } \alpha_1 = \alpha_2 = \ldots = \alpha_N = \alpha \text{ and } Z_n = \sum_{i=1}^{N} Z_i \tag{10-2}$$

In Equation (10-0), the measured impedance is the sum of the impacts from the bond condition shown as $Zcb_i$ and the tubing eccentricity Zecc. The weights $\alpha_i$ and $\beta_i$ are determined by the nominal values of the geometries and properties of the target system 1007 without tubing eccentricity. In Equation (10-2), $Z_n$ is the nominal value of the case where the tubing 104 is centralized inside the casing 105. In the case of that all the segments are powered by the same voltage source 1008, any changes of the eccentricity of the tubing 104 against the casing 105 will change the current responses, individually, for each one of the segments 1009. The segments' current outputs are then processed together to correct for eccentricity impacts on the impedance measurements from the segments, respectively. The number of segments $N=N_{seg}$ is selected based on the desired azimuthal accuracy of the structure. In absence of tubing 104 eccentricity against casing 105, the segmented sensor 1005 may detect the azimuthal LWC bond condition instead of a single averaged value.

Figure 10B:
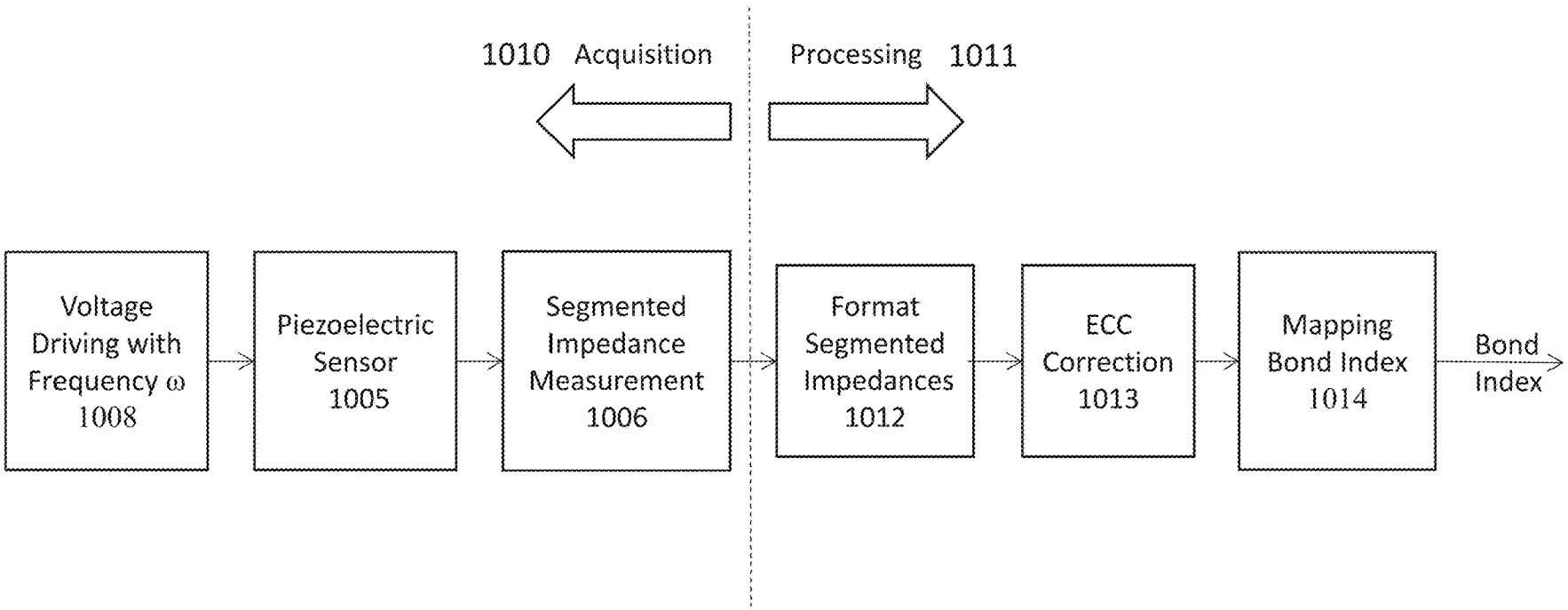

FIG. 10*b* illustrates the measurement scheme of the present disclosure in a flow chart. The scheme aims at measuring the segmented impedance from the transducer 1005 with the voltage driving 1008, which will be used in the determination of LWC properties behind the casing 105, shown in FIG. 10*a*. The measurement scheme is made of two parts, Acquisition 1010 and Processing 1011. The Acquisition 1010 is in analogue domain where the driving signal is continuously transmitted and measured. The Processing 1011 is in digital domain where the measurement samples are formatted, stored, and processed. The voltage driving module 1008 is configured to generate a fixed voltage sinusoidal signal with a selected frequency ω. The driving frequency ω is usually selected based on the configurations of downhole structure 100. The voltage signal is used to drive a piezoelectric transducer 1005 that generates mechanical vibrations to excite the downhole target structure 1007. The impedance of the driving port, corresponding to the amount of "load" of the target structure 1007, can be measured and calculated in the segmented impedance measurement unit 1006. The measured dataset will flow into the Processing 1011 for further processing steps, formatting the measured data 1012, data ECC correction 1013, and mapping data into bond index (BI) 1014. The output of the Processing 1011 is BI. The mapping reference is built through the lab calibration system and process. The Processing 1011 can be conducted in downhole and/or on the surface. The signal of the driving voltage 1008 may be a square or any other periodic signal. In that case, to measure the impedance, the harmonic analysis (for example to use FFT on the voltage driving signal 1008 and the received current signal in 1006) can be conducted to determine the impedance for the base frequency for pro-processing the impedances in the format segmented impedances 1012 to determine and mapping the LWC condition 1014 into BI. The scheme described above can be run for covering multiple frequencies if the LWC bond evaluation requires multiple impedance measurement, depending upon the applications and the needs of the data processing algorithm.

Figure 11:
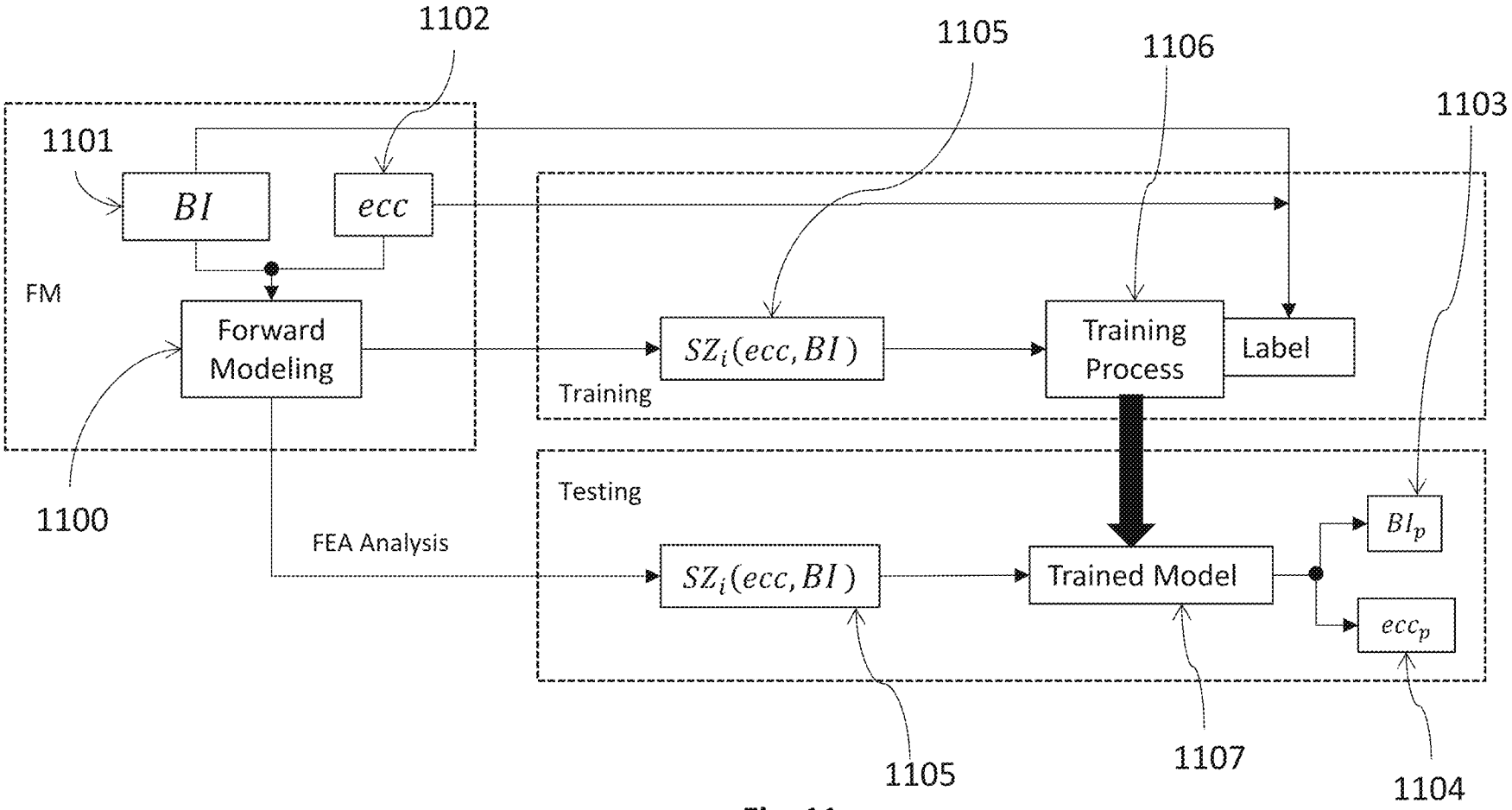
FIG. 11 shows a process used to compensate for tubing eccentricity. It incorporates a machine learning (ML) based algorithm that inputs the current output of each segment and output the corrected power consumption by the wellbore. The test data are used to confirm the accuracy of the results. Both the data used for training and testing are based on a forward modeling (FM).

FIG. 11 illustrates a block diagram describing the machine learning (ML) based algorithm to correct for the impacts from the tubing 104 eccentricity against the casing 105 on the measurements from the segments, as illustrated in FIG. 10*a* and 1013 in FIG. 10*b*. The ML is a neural network algorithm with multiple hidden layers. The algorithm requires a certain amount of data for training and testing. The data is acquired from the results of finite element analysis (FEA) simulations generated in Forward Modeling (FM) 1100 conveying various cases of eccentricities ecc 1102 and bond conditions BI 1101, which is corresponding to a specified case of well configurations 100. For each simulation case, the segment impedance responses $SZ_i$ 1105 from each segment 1009 are measured. After that, the measurements $SZ_i$ 1105 become the inputs of the ML algorithm. The outputs are two elements: (1) the overall bond index estimation $BI_p$ 1103 after the correction of the tubing 104 eccentricity impacts and (2) the tubing eccentricity estimation $ecc_p$ 1104. The entire algorithm is composed of three blocks, FM, training, and testing. As mentioned above, in the first FM block as the first step, the algorithm conducts forward modeling (FM) calculations on a specified case of tubing 104 size and cases 105 size in geometries, which consists of running a number $M_{bl}$ of cement conditions in Bond Index (BI) when a number $L_{ecc}$ of tubing eccentricity percentages starting from ecc=0 as the nominal situation without tubing 104 eccentricity presence. All $N_{seg}$ segments generate total $M_{bl} \times L_{ecc} \times N_{seg}$ of measurements $SZ_i$ 1101. The measurements $SZ_i$ 1101 will be exclusively split into two data groups for the ML training process in the second block and ML testing process in the third block. The training data group contains the majority of the data sampled evenly in the measurement data space and used for ML training process. The training process 1106 is carried out to estimate the different weights of the different neural routines inside the neural network core. Once the training process 1106 is completed, it will yield the trained Model 1107 for testing process. The testing data group is used as the measurements $SZ_i$ 1101 inputs for the trained model 1107 to evaluate the accuracy of the estimated bond index outputs $BI_p$ and tubing eccentricity $ecc_p$ from the ML algorithm. Offsets in between the predicted data $BI_p$ 1103 and $ecc_p$ 1104 from the input BI 1101 and ecc 1102 will be evaluated. Once the error of the test data is within an acceptable range, the algorithm can be used on real transducer measurement data to correct the impacts from the tubing 104 eccentricity inside the casing 105. The predicted bond index $BI_p$ 1103 with ECC corrected will be used to evaluate the TT-LWC bond conditions.

Figure 12:
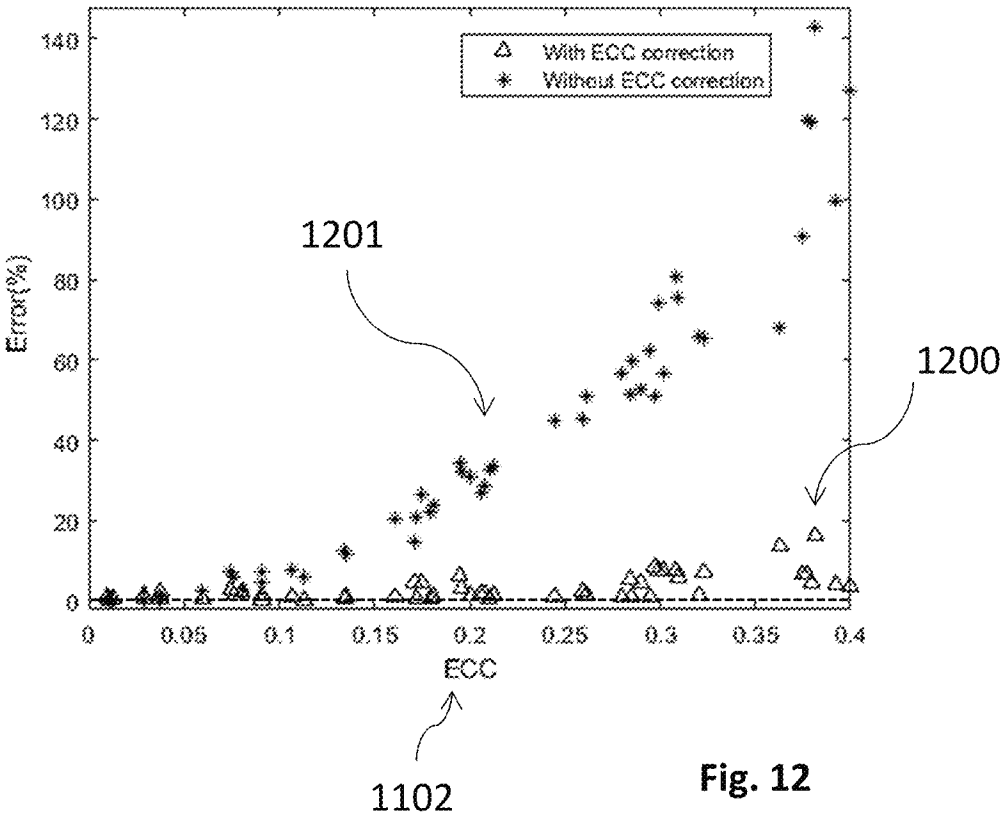
FIG. 12 presents the variation of the current measurement error as a function of eccentricity, according to an exemplary embodiment of the present invention.

FIG. 12 depicts the relative error (RE) of the ECC corrected bond index $BI_p$ vs input BI along the relative ECC, shown in Equation (9). The RE is defined as $$\text{Error} = \frac{|BI_p - BI|}{BI} \times 100 \tag{11}$$

The cluster of "stars" 1201 displays the RE of the testing data set without ML ECC correction algorithm along the increases of ECC in positively cross-correlated. The RE in 1201 is small when ECC stays in the range of 0 to 0.1. However, RE can be more than 100% as ECC reaches 0.4 or beyond in the simulation for the case study. The cluster of "triangles" 1200 shows the RE for after the ML ECC correction algorithm using the same testing data set for 1201. The RE in 1200 is significantly reduced, which indicates that the ECC correction algorithm works properly. And it can be used to reduce the impacts from tubing 104 inside the casing 105. Also, it proves that the segment measurements are necessary for TT-LWC evaluations.

Figure 13:
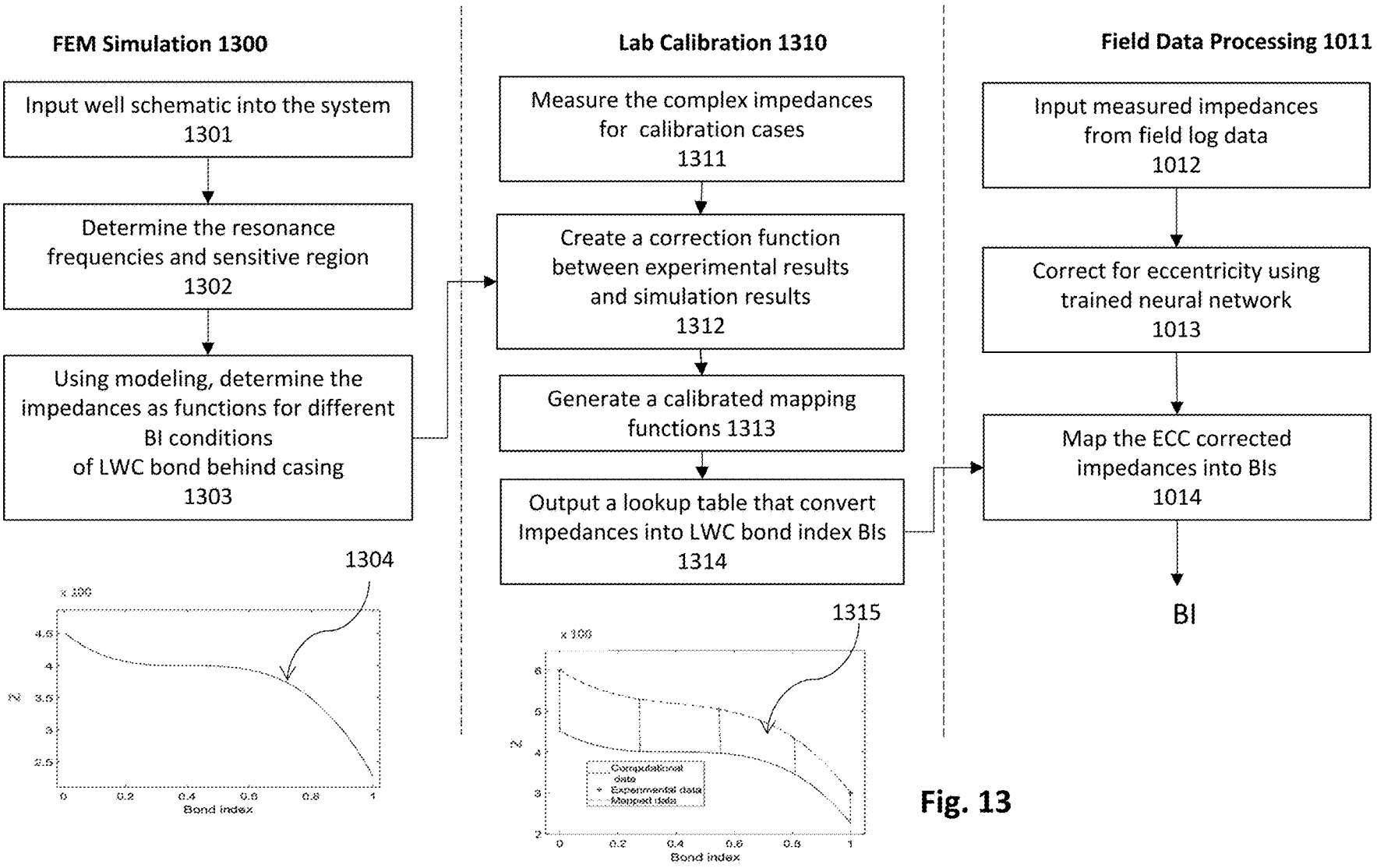
FIG. 13 is a diagram showing steps to evaluate the output current signals needed for post processing after exciting the piezo transducer with a harmonic voltage, according to an exemplary embodiment of the present invention.

FIG. 13 shows the flowchart of processes for mapping BI 1014 in FIG. 10*b*, which utilizes the LWC instrument finite element method (FEM) simulation 1300 and lab calibration 1310 into the block 1014 of mapping the ECC corrected impedances from 1013 to output BI for evaluating LWC bond conditions with or without TT. The step 1014 in Field Data Processing 1011, also shown in FIG. 10*b*, is the same functional step for mapping and outputting BI, supported by FEM Simulation 1300 and Lab Calibration 1310. In the FEM simulation 1300 stage, three steps are needed, (1) input the well schematic and pipe configurations 1301, (2) conduct the simulation over the frequency spectrum to determine the resonance frequency and region around the predefined mode shape 1302, and (3) sweep and estimate the impedance responses against different BIs 1303. Curve 1304 shows, as an example, the corresponding relationship in between measured impedances vs. Bis. The lab calibration 1310 stage includes (1) conducting the impedance measurements on the pre-selected lab calibration cases 1311, (2) creating the correction functions between the experimental results from 1311 and simulation results from FEM stage 1300, (3) generating the calibrated mapping functions 1313, and (4) outputting the mapping look-up table for converting impedances to Bis 1314. In Curve 1315, the solid line curve is the calculated data from FEM 1300 while the two asterisk points show the lab calibration measurements. The dosh line curve is an interpolated curve linking the two asterisk points from the calibration measurements and following the "trend" of the solid cure from FEM simulation results. Then the mapping points are sampled, shown in the vertical 'dot-dosh' lines, and put into the mapping table mentioned above. In the stage of field data processing 1011, the well logging dataset for impedances is input and organized in 1012. The ECC correction 1013 is illustrated in FIG. 11. The map the ECC corrected impedances into Bis by looking up the mapping table from 1314. Then the Bis can be used for LWC condition evaluations with or without TT.

Figure 14:
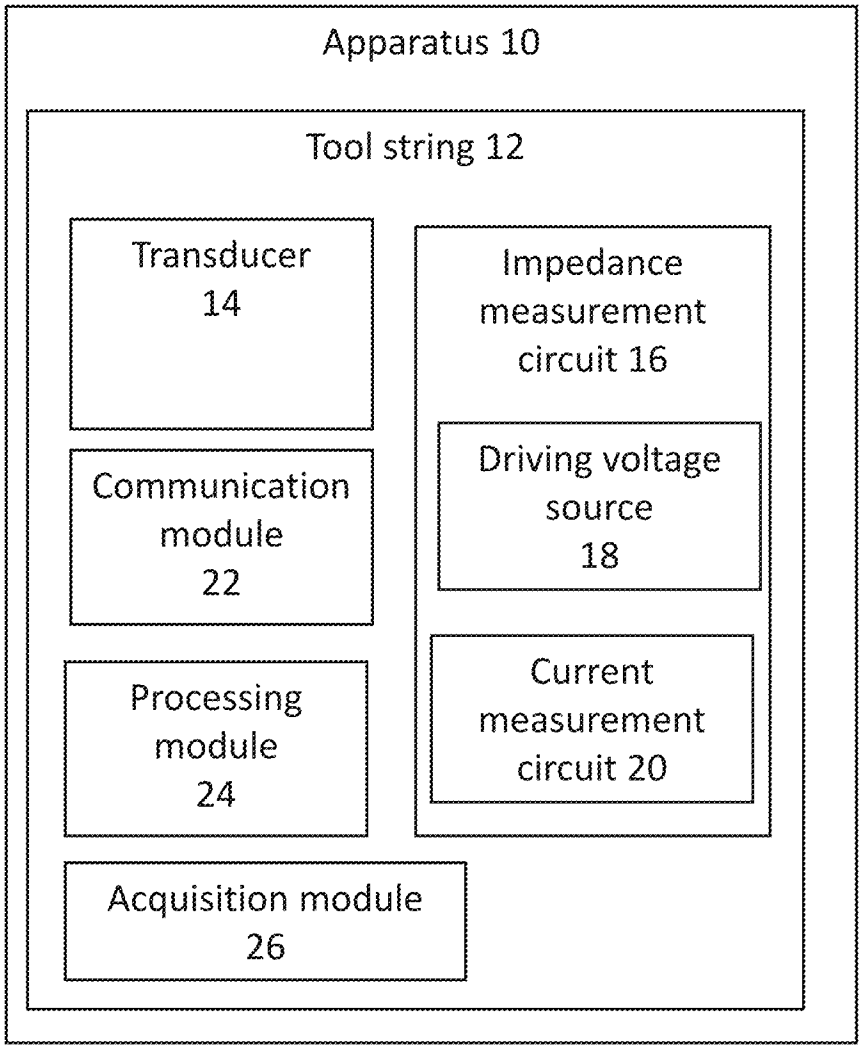
FIG. 14 is a block diagram showing an exemplary embodiment of the apparatus, according to the present invention.

FIG. 14 is a block diagram showing an exemplary embodiment of the present invention. The apparatus 10 includes a tool string 12. The tool sting can include a housing that sealably encases different components such as to prevent ingress of moisture and dust. Also, the casing may protect the components from mechanical shocks. The tool string includes a piezoelectric transducer 14 that includes plurality of segmented transducer rings, wherein each of the plurality of segmented transducer rings comprise a plurality of segments. The piezoelectric transducer can excite a surrounding medium with a continuous harmonic force resulting in acoustic vibrations that transmits to structural components of the production well. The tool string further includes an Impedance measurement circuit 16 that includes a driving voltage source 18 and a Current measurement circuit 20. The current measurement circuitry can measure current supplied to the piezoelectric transducer. The current measurement circuitry can also measure total energy amplitude i.e., total energy supplied by the piezoelectric transducer. The driving voltage source 18 can be operably coupled to the piezoelectric transducer, wherein the plurality of segmented transducer rings is connected in parallel to the voltage source and the current measurement circuitry. The rings of the plurality of segmented transducer rings have different resonance frequencies and Q-values to cover an operation range of the one or more natural resonance frequencies for evaluating the lightweight cement bond conditions.

The apparatus further includes a communication module 22 to enable communication between the tool string and the surface unit (either by sending the data from the tool to the surface or by sending commend from the surface to the tool). The communication module can be optional, and the tool string can operate on a memory mode. In this case, all acquired data are stored into a memory chip encased within the tool string.

The apparatus further includes an Acquisition module 26. The Acquisition module 26 can acquire data from the current measurement circuit and convert it into impedance value. This module also oversees the filtering and the processing of measured data. One or more steps of the Acquisition module 26 can also be processed by a Processing module 24. It is understood that the apparatus can include suitable processor and memory operably coupled to different components for operating the same. For example, the processing module can include a processor and a memory, wherein the memory can store different instruction which upon execution performs one or more steps of disclosed methodology. The acquisition module can be same as the processing module. Alternatively, the acquisition module can have a different processor and memory. The processor can be any logic circuitry that responds to, and processes instructions fetched from the memory. The memory may include one or more memory chips capable of storing data and allowing any storage location to be directly accessed by the processor. The memory includes instructions according to the present invention for execution by the processor to perform one or more steps of the disclosed methodology.

Although the present invention has been thoroughly described in detail, it should be understood and implied that any modifications and changes that do not depart from the fundamental principle of the present invention as defined in the respective claims section below may be allowed.

What is claimed is:

1. A method for evaluating lightweight cement bond conditions in a production well by determining elastic structure nonharmonic resonances, wherein the production well comprises lightweight cement for completion, the method comprising:

providing an apparatus, the apparatus comprising:

a tool string, the tool string comprises:

a piezoelectric transducer comprising one or more segmented transducer rings, wherein each of the one or more segmented transducer rings comprise a plurality of segments, the piezoelectric transducer is configured to excite a surrounding medium with a continuous harmonic force resulting in acoustic vibrations; and a current measurement circuitry configured to measure current supplied to the piezoelectric transducer;

a processing module configured to determine one or more natural resonance frequencies based on at least the current supplied and determine resonance frequency peak drift based on the one or more natural resonance frequencies for evaluating the lightweight cement bond conditions; and assessing the one or more natural resonance frequencies and their corresponding mode shape in the production well, wherein the production well has a tubing, a casing, a lightweight cement layer in between the casing and a formation, an annular space between the casing and the tubing is filled with borehole fluids, wherein the method further comprises:

positioning the tool string within the tubing; and centralizing the tool string relative to the tubing using a centralizer coupled to the tool string, wherein the apparatus comprises the centralizer, wherein the tubing is eccentric relative to the casing, wherein the processing module is further configured to:

determine segmented electrical impedances corresponding to the lightweight cement bond conditions based on returning current from each segment of the plurality of segments of the one or more segmented transducer rings from the current measurement circuitry, wherein the processing module is further configured to:

determine segmented mechanical impedances from the segmented electrical impedances;

determine overall mechanical impedance from the segmented mechanical impedances;

correct effects from tubing eccentricity on evaluation of lightweight cement bond conditions; and generate a map to convert mechanical impedances into bond indexes for the evaluation of lightweight cement bond conditions.

2. The method according to claim 1, wherein the current measuring circuitry is further configured to determine a total energy amplitude of the piezoelectric transducer, wherein the total energy amplitude is also used for evaluating the lightweight cement bond conditions.

3. The method according to claim 1, wherein each segment of the plurality of segments is independently connected to the current measurement circuitry.

4. The method according to claim 1, wherein the tool string further comprises:

a voltage source operably coupled to the piezoelectric transducer, wherein the one or more segmented transducer rings comprise a plurality of segmented transducer rings, wherein the plurality of segmented transducer rings is connected in parallel to the voltage source and the current measurement circuitry to derive the segmented electrical and mechanical impedances.

5. The method according to claim 4, wherein rings of the plurality of segmented transducer rings have different resonance frequencies and Q-values to cover an operation range of the one or more natural resonance frequencies for evaluating the lightweight cement bond conditions.

6. The method according to claim 5, wherein the plurality of segmented transducer rings is configured to operate in a radial vibration mode.

7. The method according to claim 1, wherein the processing module is configured to use a neural network-based ML algorithm incorporated with finite element method simulation in forward modeling for compensating for the tubing eccentricity relative to the casing.

8. An apparatus for evaluating lightweight cement bond conditions in a production well by determination of elastic structure nonharmonic resonances, the production well comprises lightweight cement for completion, the apparatus configured for assessing one or more natural resonance frequencies and their corresponding mode shape in the production well, the apparatus comprising:

a tool string, the tool string comprises:

a piezoelectric transducer comprising one or more segmented transducer rings, wherein each of the one or more segmented transducer rings comprise a plurality of segments, the piezoelectric transducer is configured to excite a surrounding medium with a continuous harmonic force resulting in acoustic vibrations; and a current measurement circuitry configured to measure current supplied to the piezoelectric transducer;

a processing module configured to:

determine the one or more natural resonance frequencies based on at least the current supplied, and determine resonance frequency peak drift based on the one or more natural resonance frequencies for evaluating the lightweight cement bond conditions, wherein the processing module is further configured to:

determine segmented electrical impedances corresponding to the lightweight cement bond conditions based on returning current from each segment of the plurality of segments of the one or more segmented transducer rings from the current measurement circuitry, determine segmented mechanical impedances from the segmented electrical impedances;

determine overall mechanical impedance from the segmented mechanical impedances;

correct effects from tubing eccentricity on evaluation of lightweight cement bond conditions; and generate a map to convert mechanical impedances into bond indexes for the evaluation of lightweight cement bond conditions.

9. The apparatus according to claim 8, wherein the current measuring circuitry is further configured to determine a total energy amplitude of the piezoelectric transducer, wherein the total energy amplitude is also used for evaluating the lightweight cement bond conditions.

10. The apparatus according to claim 8, wherein each segment of the plurality of segments is independently connected to the current measurement circuitry.

11. The apparatus according to claim 8, wherein the tool string further comprises:

a voltage source operably coupled to the piezoelectric transducer, wherein the one or more segmented transducer rings comprise a plurality of segmented transducer rings, wherein the plurality of segmented transducer rings is connected in parallel to the voltage source and the current measurement circuitry to derive the segmented electrical and mechanical impedances.

12. The apparatus according to claim 8, wherein the one or more segmented transducer rings comprises a plurality of segmented transducer rings, rings of the plurality of segmented transducer rings have different resonance frequencies and Q-values to cover an operation range of the one or more natural resonance frequencies for evaluating the lightweight cement bond conditions.

13. The apparatus according to claim 12, wherein the plurality of segmented transducer rings is configured to operate in a radial vibration mode.

14. The apparatus according to claim 8, wherein the processing module is configured to use a neural network-based ML algorithm incorporated with finite element method simulation in forward modeling for compensating for the tubing eccentricity relative to a casing, wherein the neural network-based ML algorithm is stored in a memory of the processing module, the processing module further comprises a processor.

* * * * *